US007586485B2

(12) United States Patent
Teshirogi et al.

(10) Patent No.: US 7,586,485 B2
(45) Date of Patent: Sep. 8, 2009

(54) CONTROLLER DRIVER AND DISPLAY APPARATUS

(75) Inventors: Yoshiyuki Teshirogi, Kanagawa (JP); Takashi Nose, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 940 days.

(21) Appl. No.: 11/129,470

(22) Filed: May 16, 2005

(65) Prior Publication Data

US 2005/0253833 A1 Nov. 17, 2005

(30) Foreign Application Priority Data

May 14, 2004 (JP) ..... 2004-144676

(51) Int. Cl.
*G09G 5/00* (2006.01)

(52) U.S. Cl. ..... 345/204; 345/98; 345/100

(58) Field of Classification Search ..... 345/98–100, 345/204, 530, 531
See application file for complete search history.

(56) References Cited

U.S. PATENT DOCUMENTS

| | | | | |
|---|---|---|---|---|
| 4,369,504 | A | 1/1983 | Hanmura | |
| 2001/0024199 | A1 * | 9/2001 | Hughes et al. | 345/204 |
| 2002/0030652 | A1 | 3/2002 | Shibata et al. | |
| 2002/0113781 | A1 | 8/2002 | Ishiyama | |
| 2003/0137527 | A1 * | 7/2003 | Lin et al. | 345/698 |
| 2003/0169244 | A1 * | 9/2003 | Kurokawa et al. | 345/204 |
| 2004/0012551 | A1 | 1/2004 | Ishii | |
| 2004/0140985 | A1 * | 7/2004 | Liaw | 345/690 |
| 2005/0068343 | A1 * | 3/2005 | Pan et al. | 345/690 |
| 2005/0146495 | A1 * | 7/2005 | MacKinnon et al. | 345/98 |

FOREIGN PATENT DOCUMENTS

| | | |
|---|---|---|
| JP | 4-365094 | 12/1992 |
| JP | 2004-78129 | 3/2004 |

OTHER PUBLICATIONS

Communication and European Search Report, dated Dec. 20, 2007.

* cited by examiner

*Primary Examiner*—Amare Mengistu
*Assistant Examiner*—Koosha Sharifi
(74) *Attorney, Agent, or Firm*—Young & Thompson

(57) ABSTRACT

A driving apparatus for over-drive driving includes a display memory, a memory control circuit performing control for receiving input image data supplied from an image rendering device, reading out image data one frame before of the input image data from the display memory and for writing the input image data in the display memory as write image data for the display memory, and a image data control circuit for verifying whether or not the input image data from the memory control circuit coincides with the readout image data one frame before read out from the display memory. The apparatus also includes an LUT for outputting converted image data, a transfer data control circuit for selectively outputting the input image data or the converted image data, and latch circuits for latching image data of one horizontal line equivalent of pixels. A shift register circuit generates latch signal for image data.

25 Claims, 19 Drawing Sheets

CONTROLLER DRIVER AND DISPLAY APPARATUS

FIELD OF THE INVENTION

The present invention relates to a display apparatus and, more particularly, to an apparatus, termed a controller driver, arranged between an upper layer apparatus and a display unit for exercising driving control of a data line of the display unit, and a display apparatus.

BACKGROUND OF THE INVENTION

FIG. 15 is a diagram showing an example of a typical configuration of a conventional controller driver 100 (for example, see Non-Patent Document 1 below). Referring to FIG. 15, the controller driver 100 (display control driving apparatus) is arranged between an image rendering device 20, such as CPU (central processing unit), as an upper layer device, and a display unit 30, for receiving image data for display from the image rendering device 20 to control the display thereof on the display unit 30, and includes a display memory 121 for storing image data for at least one frame (termed a frame memory), a latch circuit 122, a data line drive circuit 123, a memory control circuit 124, a timing control circuit 125 and a grayscale voltage generating circuit 126. Meanwhile, the controller driver, shown in FIG. 15, is formed as e.g. a semiconductor device (IC).

In the controller driver 100, the memory control circuit 124 receives image data (k bits per pixel) from the image rendering device 20 to write image data (H bits per pixel in the horizontal direction and V pixels in the vertical direction, with each pixel being of k bits), in the display memory 121.

The timing control circuit 125 outputs a timing control signal to the memory control circuit 124, while supplying a latch signal, a gate start pulse signal and a strobe signal STB to the latch circuit 122, a gate line drive circuit 31 and to the data line drive circuit 123, respectively.

The latch circuit 122 latches data for one line (H pixels×k bits), read and output from the display memory 121, responsive to the latch signal from the timing control circuit 125, to send the so latched data to the data line drive circuit 123.

The data line drive circuit 123 receives a grayscale voltage output (analog voltage) from the grayscale voltage generating circuit 126, and receives a digital data signal (k bits) from the latch circuit 122 to drive the data line of the display unit 30 with a grayscale voltage signal corresponding to the data signal. The data line drive circuit 123 is activated by the strobe signal STB from the timing control circuit 125. A pixel switch, not shown, connected to the gate line selected and activated by the gate line drive circuit 31 is turned on, and a grayscale voltage signal from the data line, the pixel switch is connected to, is applied to the display element for pixel (pixel electrodes in the case of liquid crystal elements), whereby pixels of one horizontal line are displayed. By the same sequel of operations, pixel data of pixels for one horizontal line, output in succession from the display memory 121, are latched by the latch circuit 122. A grayscale voltage signal is output from the data line drive circuit 123 to the display unit 30, and the horizontal line, as selected by the gate line drive circuit 31, is sequentially displayed to display V lines forming one frame. The gate line drive circuit 31 is responsive to a gate start pulse signal to advance the selected line by one to activate the associated gate line. The gate line drive circuit 31 is composed e.g. by a shift register which receives a gate start pulse signal, as a shift clock, for example, to shift a gate line to be activated sequentially.

In the controller driver 100, shown in FIG. 15, the latch circuit 122 includes H latch circuits arranged in parallel, latching image data of H pixels, equivalent to a horizontal line. It is noted that the image data per pixel is of k bits, and that each of the latch circuits latches simultaneously k-bit parallel data with the received latch signal. In similar manner, the data line drive circuit 123 includes H data line drive circuits arranged in parallel for driving H data lines. In FIG. 15, for the sake of simplicity of illustration, pixel data for a pixel are displayed in gray scale made up of a luminance signal. In case RGB data are provided as data for one pixel, the image data for one pixel is e.g. 3×k bits.

FIG. 16 shows an example of the timing operation of a display apparatus shown in FIG. 15. In FIG. 16, CLK denotes a clock signal supplied to the controller driver 100, an Address is an access address of the display memory 121 and k-bit input image data [k−1: 0] is image data of k bits in width, supplied from the image rendering device 20 to the controller driver 100. Meanwhile, [k−1: 0] in the input image data [k−1: 0] means parallel bit data from bit 0 to the number [k−1] bit, with the bit width of k bits. A display memory control signal is output from a memory control circuit 124 to a display memory 121. The latch signal is a signal output from the timing control circuit 125 to the latch circuit 122. The strobe signal STB is a signal supplied from the timing control circuit 125 to the data line drive circuit 123.

Referring to FIG. 16, write image data are sequentially written in associated addresses of the display memory 121, every clock cycle, responsive to a display memory WRITE signal (pulse signal), output every cycle of the clock signal CLK, under control by the memory control circuit 124. That is, as input image data for pixels of one horizontal line, input image data for (n+1) pixels are sequentially entered in association with (n+1) (=H) addresses, with the address y along the column direction of 0 and the addresses x along the row direction of from 0 to n in the display memory 121. The memory control circuit 124 outputs a display memory WRITE signal (pulse signal) every clock cycle and, responsive to the a display memory WRITE signal, write image data are sequentially written in the display memory 121, in terms of a pixel as a unit. In the case of FIG. 16, write image data items D0, D1, D2, D3, . . . , Dn−1, and Dn are sequentially written in the display memory 121, responsive to the display memory WRITE signal, activated every clock cycle. The image data, stored in the display memory 121, are read from the display memory 121 every line (every H pixels), for example, and image data of the pixels of one horizontal line, output in parallel, are latched by H latch circuits of the latch circuit 122, responsive to a latch signal output from the timing control circuit 125, such that the grayscale voltage matched to the image data is output, by the data line drive circuit, activated responsive to the strobe signal STB, to the data line of the display unit 30, responsive to the data line drive circuit 123, activated responsive to the strobe signal STB.

Meanwhile, in the above-described conventional controller driver, includes a display memory 121 for one frame, enclosed therein and, if the display picture is not switched, image data transfer from the image rendering device (CPU) 20 is halted to output image data stored in the display memory 121 to the display unit 30. The display memory 121 is enclosed with a view to reducing the power consumption, by transferring image data of only changed pixels from the image rendering device (CPU) 20, even when the display picture is changed over to a new picture.

Recently, video as well as TV functions are loaded on a mobile phone and chances of displaying moving images have increased in keeping with diversified functions of the mobile phone. Each frame is on the order of 60 Hz (16.7 msec). The response speed of a liquid crystal material is on the order of 20 to 30 msec for binary representation for white and black. For half tone representation, the response speed may occasionally exceed 100 msec.

FIG. 17 schematically shows a response example of a liquid crystal panel. FIG. 17 shows that the luminance response is delayed against changes in the applied voltage. There are occasions where the response time of several frames is taken until desired luminance is reached.

As a method for improving the response speed of the liquid crystal, there has so far been proposed driving according to a over-drive method (hereinafter referred to as "over-dive driving"). If, in this over-drive method, a change has occurred in a picture, as shown in FIG. 18, a voltage higher than the usual voltage is applied to a liquid crystal panel during rise time and, during fall time, a voltage lower than the usual voltage is applied thereto, such as to improve the response speed at the time of changes in the grayscale. Since the over-drive and the under-drive may be present together, depending on the direction of transition, the term 'response time compensation (RTC) is sometimes used in place of the over-drive and the under-drive (for example, see Non-Patent Document 2, indicated hereinbelow).

FIG. 19 shows an illustrative configuration of effecting the over-drive driving (for example, see Non-Patent Document 1, indicated hereinbelow). Referring to FIG. 19, this liquid crystal panel apparatus includes a segment electrode drive circuit 204, an image memory 201 for storage of one frame of digital pictures for display, and a ROM (read-only memory) 202, also termed a lookup table, having stored therein a table for image data corresponding to two inputs of image data read out with a delay of one frame from the image memory 201. In case image data have changed, optimum image data, stored from the outset in the ROM 202, are read out, in dependence upon the magnitude and the direction of the change caused, to drive a liquid crystal panel to render the rise and the decay of the light transmittance acute within a necessary sufficient range. Meanwhile, a synchronization control circuit 203 supplies a write/readout signal for the image memory 201, while supplying a timing signal to a segment electrode drive circuit 204 and to a common electrode drive circuit 205.

There has also been known a configuration of a liquid crystal panel driving apparatus for effecting the over-drive driving, using a frame memory and a lookup table, in which part of input data and part of data of a previous frame from a frame memory are supplied as addresses to the lookup table and data for over-drive is generated based on output data of the lookup table and on a non-use part of the address of the input data, such as to reduce the memory volume of the lookup table as well as to reduce the step differences of over-drive data (see, for example, the Patent Document 2, indicated hereinbelow).

Patent Document 1

JP Patent Kokai Publication No. JP-A-4-365094 (FIG. 1)

Patent Document 2

JP Patent Kokai Publication No. JP-P2004-78129A (FIG. 1)

Non-Patent Document 1

μ PD161622 Data Sheet S15469JJV0DS [386 output TFT with enclosed RAM-Source Driver for output TFT-LCD], page 2, ULR <http://www.necel.com/nesdis/images/S15649JJ2VODS00.pdf>.

Non-Patent Document 2

Richard I. McCartney, 48.3: A Liquid Crystal Display Response Time Compensation Feature Integrated into an LCD Panel Timing Controller, SID 03 DIGEST

SUMMARY OF THE DISCLOSURE

In case the configuration shown in FIG. 19 is applied to a controller driver (also termed a controller driver IC) of a display device of a mobile terminal, it becomes necessary to provide an image memory for storage of image data for a directly previous frame, apart from the display memory. The result is the increased size of the circuit, and increased power consumption and interconnections.

This point will now be explained taking an example of the controller driver 100 shown in FIG. 15. In this controller driver 100, image data read out from the display memory 121 is transferred to a latch circuit 122, as shown in FIG. 5. If, in such configuration, in order for the over-drive driving to be achieved, it is necessary to process the input image data by over-drive processing and to write image data following the over-drive driving in the display memory 121.

The over-drive processing is determined by the lookup table, based on the input image data and image data of the directly previous frame, as described above. Hence, in order for the configuration of FIG. 15 to be able to cope with over-drive driving, it becomes necessary to provide a separate frame memory for holding image data of the directly previous frame (image data one frame before) of the input picture.

In case the memories for storing image data of two frames are provided in order to cope with over-drive driving, the circuit size and power consumption are increased and hence it becomes difficult to apply the controller driver to e.g. a mobile phone for which a demand is raised for reducing the size of the device and the power consumption.

The invention disclosed in the present invention typically may be summarized as follows:

In one aspect, the present invention provides a controller driver comprising a display memory for storing at least one frame of image data, a memory control circuit for performing control for receiving input image data supplied from an image rendering device, reading out image data one frame before the input image data from the display memory and for writing the input image data as write image data in the display frame, a converting circuit supplied with the input image data and with the readout image data one frame before to output converted image data determined based on the input image data and the readout image data one frame before, a circuit for comparing the input image data and the readout image data one frame before to each other, a transfer data control circuit for verifying, based on the results of comparison of the input image data the readout image data one frame before, which of the converted image data and the input image data is to be output, and outputting one of the converted image data and the input image data, a plurality of latch circuits for receiving the image data output from the transfer data control circuit either directly or via a preset circuit and for latching the image data responsive to an input latch signal, and a plurality of drive circuits for receiving image data output from the latch circuits, as an input, and for outputting an output signal matched to the image data.

In another aspect, the present invention provides a controller driver including a display memory for storage of at least one frame of image data, and provided between an image rendering device and a display unit, in which the controller driver comprises a memory control circuit performing control for receiving input image data supplied from the image rendering device, reading out image data one frame before of the input image data from the display memory, and for writing the input image data as write image data in the display memory, a image data control circuit supplied with the input image data and the readout image data one frame before, read out from the display memory, to verify whether or not the input image data is coincident with the readout image data, a converting circuit for outputting converted image data based on the input image data and the readout image data one frame before, a transfer data control circuit for outputting the input image data or the converted image data if, based on the results of decision in the image data control circuit, the input image data and the converted image data are coincident or are not coincident with each other, respectively, a plurality of latch circuits connected via switches to output ends of the transfer data control circuit, a shift circuit generating and supplying a latch signal for each of a plurality of the latch circuits, and a plurality of data line drive circuits supplied with outputs of the latch circuits for driving corresponding data lines.

In another aspect, the present invention provides a controller driver including a display memory for storage of at least one frame of image data, and provided between an image rendering device and a display unit, in which the controller driver comprises a memory control circuit performing control for receiving input image data supplied from the image rendering device, reading out image data one frame before of the input image data from the display memory and for writing the input image data as write image data in the display memory, a image data control circuit supplied with the input image data and the readout image data one frame before, read out from the display memory, to verify whether or not the input image data is coincident with the readout image data, a converting circuit for outputting converted image data based on the input image data and the readout image data one frame before, a transfer data control circuit for outputting the input image data or the converted image data if, based on the results of decision in the image data control circuit, the input image data and the converted image data are coincident or are not coincident with each other, respectively, a data shift circuit for sequentially shifting image data output from the transfer data control circuit for holding image data of a plurality of pixels up to one frame at most, a plurality of latch circuits connected via switches to output ends of the data shift circuit and supplied with image data of plural pixels from the data shift circuit, when the switches are on, to latch the data responsive to a common latch signal, and a plurality of data line drive circuits supplied with outputs of the latch circuits for driving corresponding data lines.

In still another aspect, the present invention provides a controller driver including a display memory for storage of at least one frame of image data, and provided between an image rendering device and a display unit, in which the controller driver comprises a memory control circuit performing control for receiving input image data supplied from the image rendering device, reading out image data one frame before of the input image data from the display memory and for writing the data as write image data in the display memory, a image data control circuit supplied with the input image data and the readout image data one frame before read out from the display memory to verify whether or not the input image data is coincident with the readout image data, a converting circuit for outputting converted image data based on the input image data and the readout image data one frame before, a transfer data control circuit for outputting the input image data or the converted image data if, based on the results of decision in the image data control circuit, the input image data and the converted image data are coincident or are not coincident with each other, respectively, a memory circuit for storing image data output from the transfer data control circuit in relevant addresses for storing image data of a plurality of pixels up to one frame at most, a plurality of latch circuits connected via switches to output ends of the memory circuit and supplied with image data of plural pixels from the memory circuit, when the switches are on, to latch the data responsive to a common latch signal, and a plurality of data line drive circuits supplied with outputs of the latch circuits for driving corresponding data lines.

In yet another aspect, the present invention provides a controller driver for compensating response time using a frame memory and a lookup table, in which the controller driver includes a control circuit operating for supplying input data and data one frame before from the frame memory to the lookup table, for a response time compensation mode, and for outputting data from the lookup table if, based on the results of comparison of the input data and the data one frame before, response time compensation is needed, output data of the control circuit being latched by a relevant latch circuit, a set of data line drive circuits, receiving data output from the latch circuits, outputting data consistent with the data and in which, for other than the response time compensation mode, an output of the control circuit is disconnected from the latch circuit, and output data from the frame memory is latched by the latch circuit, the set of data line drive circuits, receiving data output from the latch circuits, outputting a signal consistent with the data, there being provided a frame memory for enabling response time compensation.

The meritorious effects of the present invention are summarized as follows.

According to the present invention, in a controller driver for comparing input image data and readout image data to effect over-drive driving, it is unnecessary to add a frame memory, thus enabling reduction in circuit size and power consumption and preventing the interconnections from being increased.

Still other effects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

Figure 1:
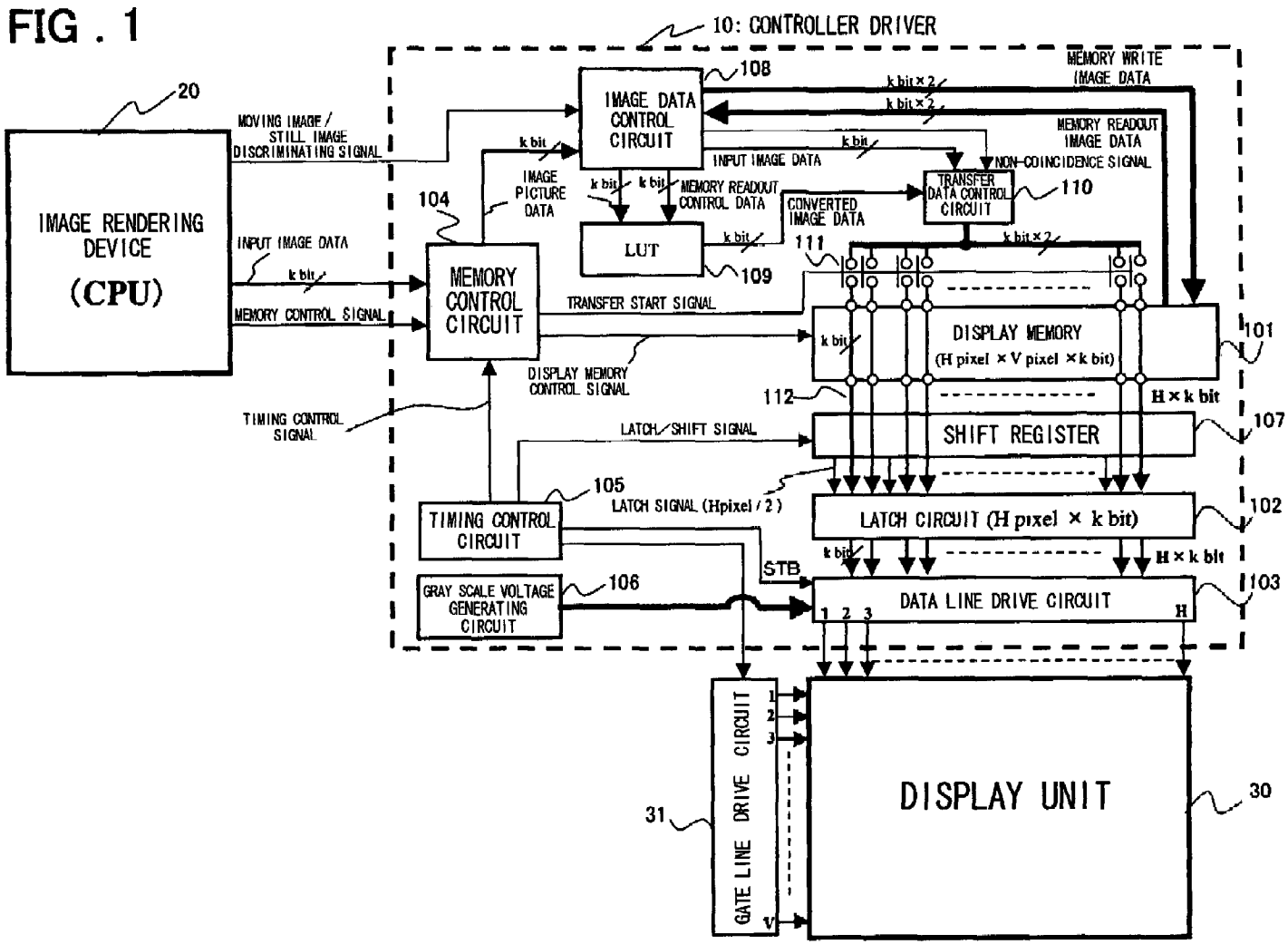
FIG. 1 is a diagram showing an overall configuration of a first embodiment of the present invention.

A preferred embodiment for carrying out the present invention is now explained. Referring to FIG. 1, a controller driver for display, according to the preferred embodiment of the present invention, includes a display memory 101, a memory control circuit 104 for exercising control for receiving input image data supplied from an image rendering device 20, reading out image data of the directly previous frame of the input image data from the display memory 101, and for supplying the input image data as write image data to the display memory 101, and a image data control circuit 108 for receiving and transiently holding the input image data from the memory control circuit 104, transiently holding the read-out image data of the directly previous frame, as read out from the display memory 101 under control by the memory control circuit 104, and for determining whether or not the input image data is coincident with the readout image data of the directly previous frame. The controller driver also includes a converting circuit 109 for outputting converted image data as determined based on the input image data and the readout image data of the directly previous frame, a transfer data control circuit 110 for outputting the input image data or the converted image data when the input image data is or is not coincident with the readout image data of the directly previous frame, respectively, and a set of latch circuits 102 for latching image data of plural pixels, for example, pixels of one horizontal line. The controller driver further includes a shift register circuit 107 for generating and outputting a latch signal for latching image data, transferred from the transfer data control circuit 110 via switches 111 turned on with a transfer start signal, by associated ones of the latch circuits of the set, and a set of data line drive circuits 103 for receiving an output of each latch circuit of the set to drive the associated data lines.

The image data control circuit 108 receives a moving image/still image discriminating signal from the image rendering device 20 and, when the moving image/still image discriminating signal indicates a still image, exercises control for supplying the input image data as write data to the display memory 101. A plural number of image data, for example, a line equivalent of image data, output from the display memory 101, are supplied to the set of latch circuits 102. The set of latch circuits 102 samples the line equivalent of image data, output from the display memory 101, to output the sampled data to the set of data line drive circuits 103, based on a latch signal for the still images.

If the moving image/still image discriminating signal indicates a moving image, image data of the directly previous frame of the input image data are read out from the display memory 101, while the input image data, transiently held by the image data control circuit 108, are supplied to the display memory 101 and written in relevant addresses. In the image data control circuit 108, it is verified whether or not the input image data are coincident with the read-out image data of the directly previous frame. Based on the results of decision, the input image data or the converted image data are output and sent to the set of latch circuits 102 through the switches 111 which are in the on-state. Responsive to the latch signal, output from the shift register circuit 107, image data are sampled by associated ones of the latch circuits of the set 102 and sent to the set of data line drive circuits 103. The image data are sampled by an associated one of the latch circuits of the set of latch circuits 102, responsive to the latch signal, output from the shift register circuit 107, and are thence supplied to associated ones of the data line drive circuits of the set 103.

If, in a preferred embodiment of the present invention, over-drive driving is to be effected during display of moving images, readout of image data of the directly previous frame from the display memory 101 and writing of the current image data in the display memory 101 of the current image data, are each carried out in terms of a plural number of pixels as a unit, so that the moving images can be suppressed from becoming blurred by a smaller number of access operations to the display memory 101.

Moreover, in a preferred embodiment of the present invention, when the image data converted for over-drive driving by the converting circuit 109, is transferred to the latch circuit 102, interconnectios (data buses) 112 from the display memory 101 to the latch circuit 112 are used. Thus, the over-drive driving may be achieved without increasing the number of interconnections.

In addition, in a preferred embodiment of the present invention, the image data stored in the display memory 101 are read out every horizontal line, that is, in terms of the total number of horizontal pixels, as a unit, and displayed via the latch circuits 102, during display of a still image, as in the conventional technique described above. During the time of display of moving images, the moving images are displayed such as to effect over-drive driving. By changing the control mode for the controller driver for still image display and for moving image display, an optimum driving method may be selected for still image display or for moving image display. The control mode of the controller driver for still image display may be switched to the moving image display, or vice versa, from the side of the image rendering device (CPU) 20, by a discriminating signal entered to the controller driver. This will be explained in more detail by a specified embodiment.

Embodiment

FIG. 1 shows the configuration of a first embodiment of the present invention. In FIG. 1, the controller driver 10 is arranged between an image rendering device 20 and a display unit 30 and includes a display memory 101, a set of latch circuits 102, a set of data line drive circuits 103, a memory control circuit 104, a timing control circuit 105, a grayscale voltage generating circuit 106, a shift register circuit 107, a image data control circuit 108, a lookup table 109, a transfer data control circuit 110, switches 111 and data transfer lines 112. The image rendering device 20 is composed e.g. by a CPU, whilst the display unit 30 is an LCD (liquid crystal display) or an EL (electro luminescence) display.

In the controller driver 10, the display memory 101 stores image data corresponding to one frame (H×V pixels)

Figure 15:
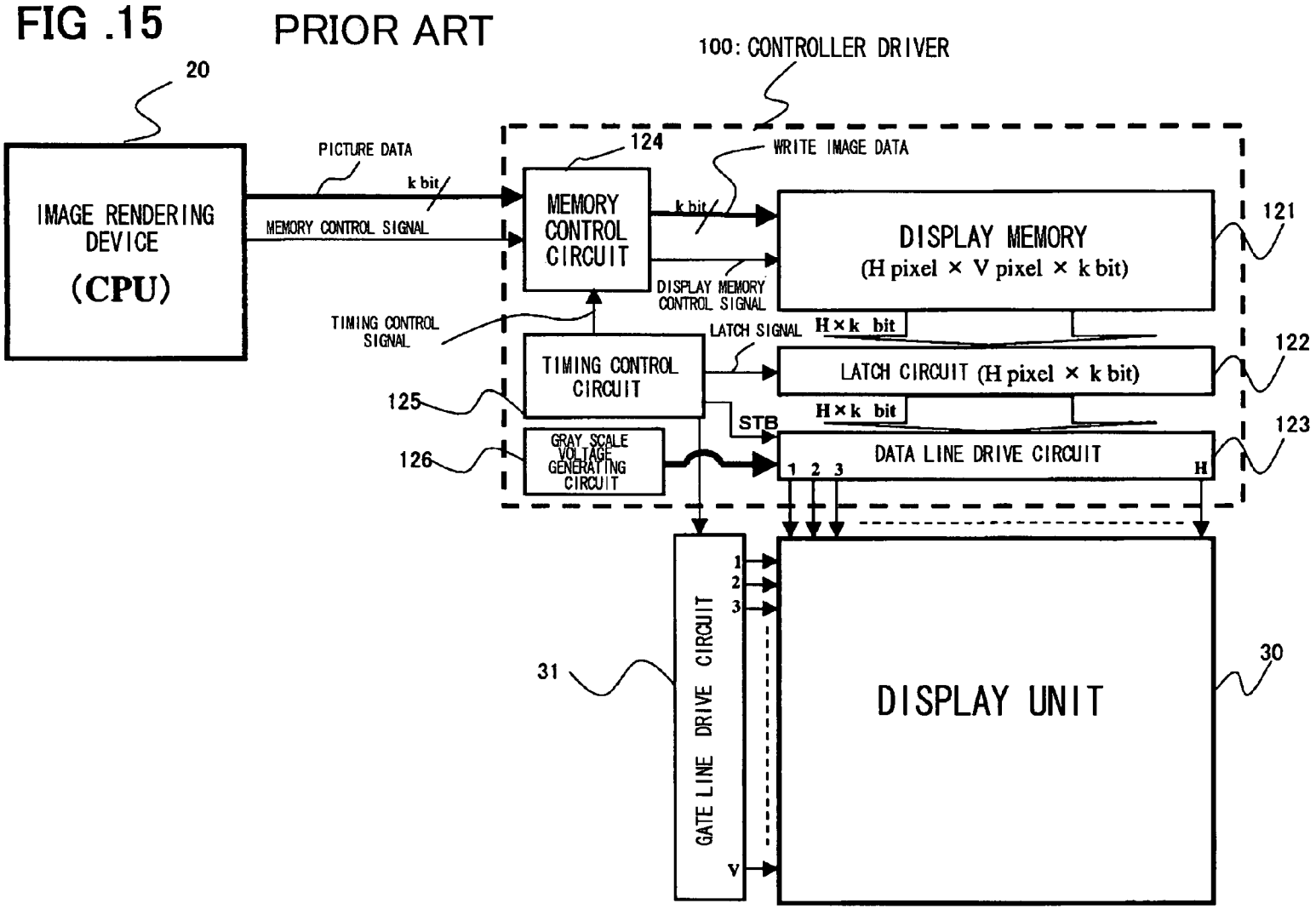
FIG .15 PRIOR ART
FIG. 15 is a diagram showing a typical configuration of a conventional controller driver.
Figure 16:
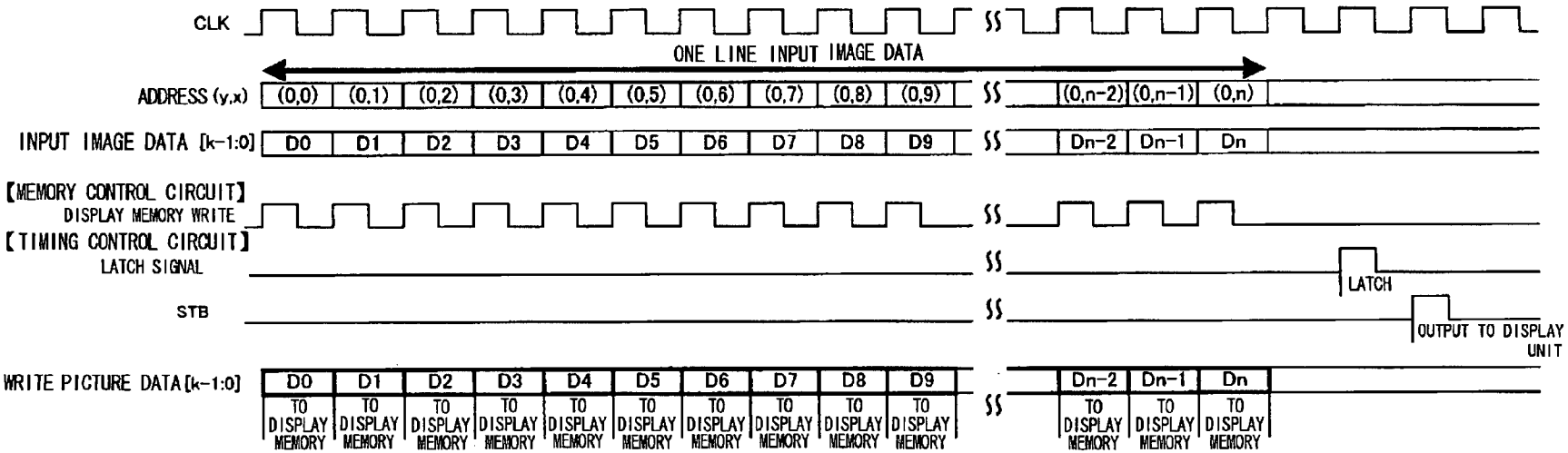
FIG. 16 PRIOR ART
FIG. 16 is a timing chart for illustrating a typical operation of the controller driver of FIG. 15.
Figure 17:
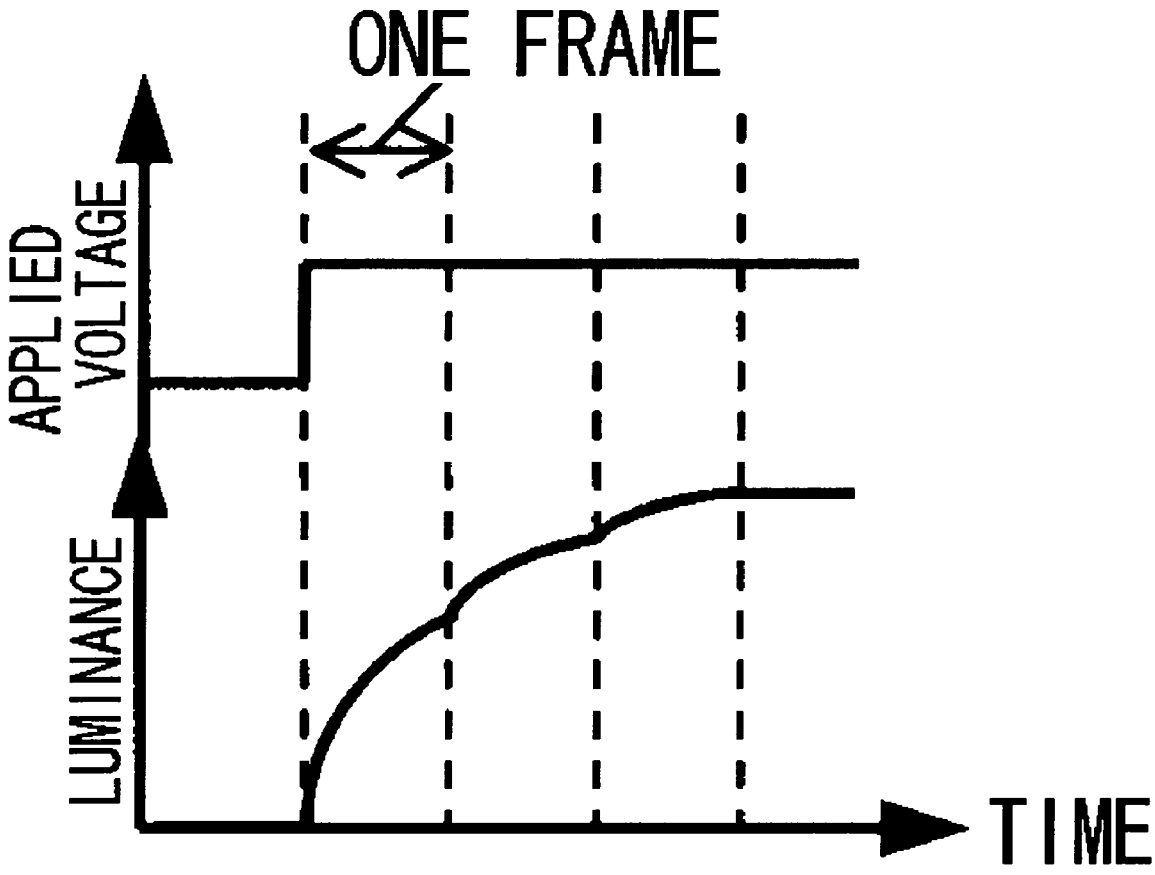
FIG . 17 PRIOR ART
FIG. 17 illustrates the response speed of a conventional liquid crystal.
Figure 18:
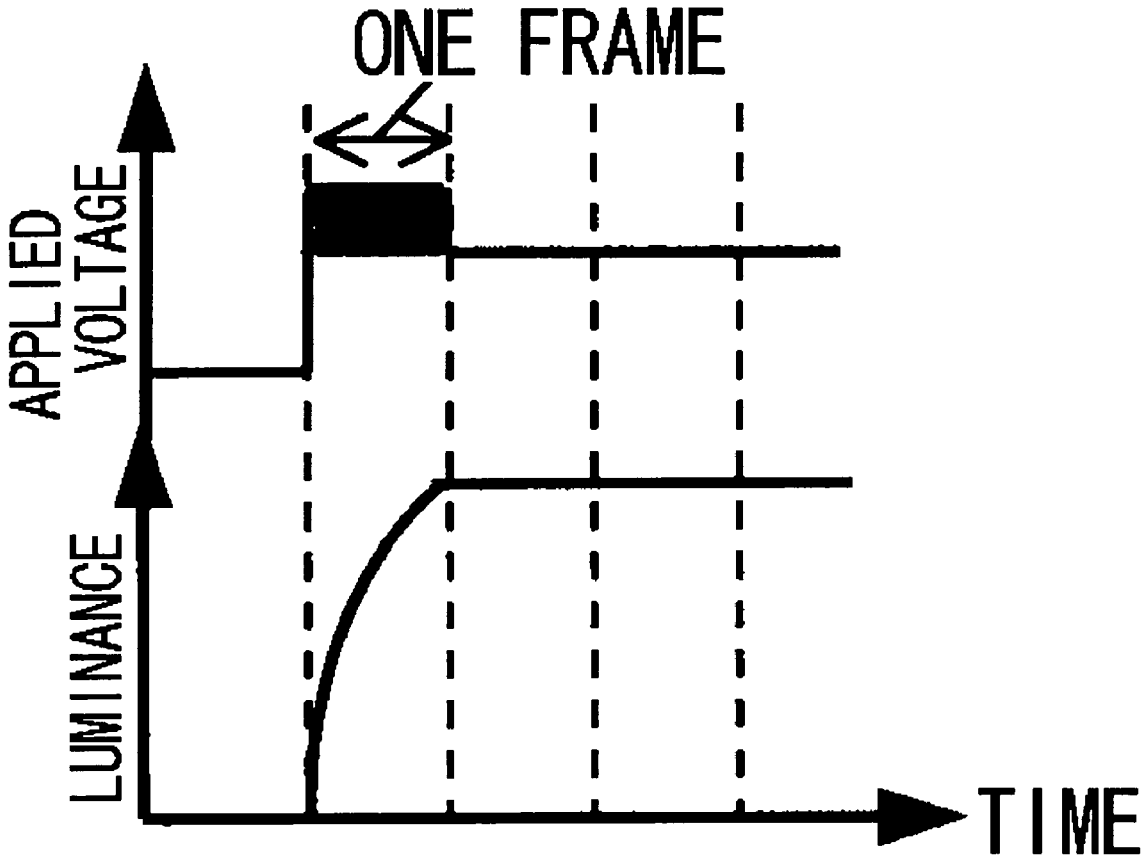
FIG . 18 PRIOR ART
FIG. 18 illustrates the response speed of a liquid crystal panel driving device of an over-drive system.
Figure 19:
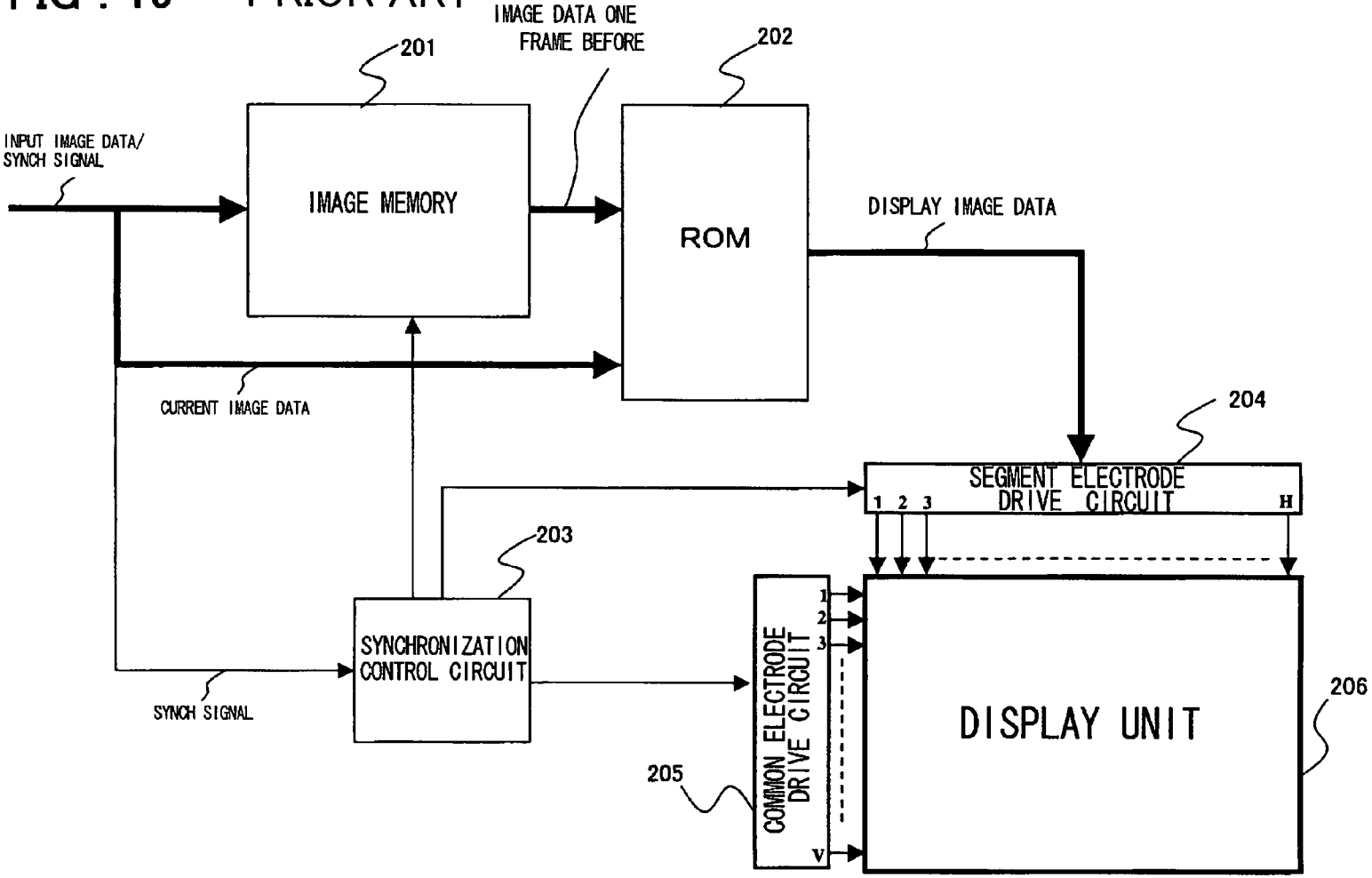
FIG. 19 PRIOR ART
FIG. 19 is a diagram showing a configuration of a liquid crystal panel driving apparatus of the conventional over-drive system.

The memory control circuit 104 receives input image data from the image rendering device 20, such as CPU and a memory control signal from the image rendering device 20 to generate a display memory control signal which is then sent to the display memory 101. It is noted that the number of bits per pixel of the output image data is k. Similarly to the circuit shown in FIG. 15, the memory control circuit 104 receives a timing control signal from the timing control circuit 105. The timing control circuit 105 sends a gate start pulse signal and a strobe signal STB to the gate line drive circuit 31 and to the set of data line drive circuits 103 respectively.

The image data control circuit 108 receives the moving image/still image discriminating signal, output from the image rendering device 20 and receives input image data from the memory control circuit 104 to hold the data in an input data register, not shown. The moving image/still image discriminating signal is set to a value indicating a moving image and to a value indicating a still image when the input image data sent from the image rendering device 20 to the controller driver 10 is a moving image and a still image, respectively. The input image data from the image rendering device 20 is sequentially supplied to the controller driver 10 over a data bus of e.g. a width of k bits. Meanwhile, in FIG. 1, the image data of each pixel, with the number of bits per pixel being k, are in gray scale representation, displaying only a luminance signal, for simplicity of explanation. In case RGB data are provided as data for one pixel, the image data per pixel is e.g. 3×k bits.

In the following, the flow of data through the image data control circuit 108, lookup table 109, transfer data control circuit 110, shift register circuit 107, memory control circuit 104, timing control circuit 105, set of latch circuits 102, and the set of data line drive circuits 103, in the present embodiment, and control of the data, in case the moving image/still image discriminating signal indicates a moving image, are schematically described.

That is, in case the moving image/still image discriminating signal indicates a moving image, the image data control circuit 108 reads out two pixels of image data of the directly previous frame, already written in the display memory 101, in parallel, and holds the image data corresponding to the so read out two pixels in a readout register, not shown. From the image data control circuit 108, input image data for two pixels are output as image data of two pixels (k bits×2), to be written in the display memory 101, and are written in the display memory under control by the memory control circuit 104. It is noted that the image data of two pixels, to be written in the display memory 101, are written in the address from which the image data of two pixels of the directly previous frame were read out, under control by the memory control circuit 104, with a time shift as from the readout timing of the two pixels of the image data.

The image data control circuit 108 checks whether or not the input image data of k bits, received from the memory control circuit 104, are in non-coincidence with respect to the memory readout image data of k bits of the directly previous frame of the input image data, read out from the memory. The image data control circuit then sends the result of judgement as a non-coincidence signal to the transfer data control circuit 110.

The image data control circuit 108 sends the input image data of k bits, received from the memory control circuit 104, to the transfer data control circuit 110, and sends the input image data and the memory readout image data of the directly previous frame, to the lookup table 109.

The lookup table 109 receives the input image data (k bits) supplied from the image data control circuit 108, and with image data (k bits) of the directly previous frame of the input image data, and outputs so read out image data with the respective image data entered as addresses. These image data are data for effecting over-drive driving or under-drive driving and referred as to 'converted image data'. The converted image data is output to the transfer data control circuit 110. The converted image data is set, depending on the direction and the magnitude of change of the input image data to the memory readout image data of the directly previous frame, to a signal value which makes the rise and the fall of the response of the luminance of the display element acute within a necessary and sufficient extent.

The transfer data control circuit 110 receives the non-coincidence signal and the input image data, output from the image data control circuit 108, while also receiving the converted image data, output from the lookup table 109. If the non-coincidence signal indicates non-coincidence, the transfer data control circuit 110 selects and outputs the converted image data, whereas, if the non-coincidence signal indicates coincidence, the transfer data control circuit outputs input image data.

In the present embodiment, the transfer data control circuit 110 outputs two-pixel equivalent of image data (k bits×2) in parallel. There is provided a register for storage of even-numbered data and odd-numbered data in upper and lower k bits, respectively. The two-pixel equivalent of image data (k bits×2) is sent from the register via switches 11 set to the on-state to the set of latch circuits 102 (H latch circuits).

The switches 111 are in the on-state during the time the transfer start signal from the memory control circuit 104 is in an activated state.

In the present embodiment, the shift register circuit 107 is made up by H/2 stages of cascaded flip-flops, and performs shifting by a shift signal of a latch/shift signal as supplied from the timing control circuit 105 to sequentially activate and output H/2 latch signal in keeping with two-pixel equivalent of the image data, output from the transfer data control circuit 110. That is, when the moving image/still image discriminating signal indicates moving images, the shift register circuit 107 outputs the H/2 latch signal, output from the H/2 stages of the flip-flops and having the activation timing shifted by a period of the shift signal as supplied from the timing control circuit 105. The operation of the shift register circuit 107 for a still image will be described subsequently.

The set of latch circuits 102 is composed by H latch circuits arranged in parallel, corresponding to H pixels constituting a horizontal line. These H latch circuits latch and output image data of which each pixel is made up by k bits. Two of the H latch circuits co-own the latch signal output from the shift register circuit 107. That is, two of the latch circuits, associated with the two-pixel equivalents of the image data (k bits×2), are responsive to the common latch signal, output from the shift register circuit 107, to send the so latched two-pixel equivalent of the image data to the input ends of the relevant two data line drive circuits associated therewith.

The data line drive circuits 103 is made up by H data line drive circuits arranged in parallel, each having an input end of each of the H latch circuits and each having an output end connected to each of H data lines. Each of the H data line drive circuits receives k-bit image data, output from an associated latch circuit, and with a grayscale voltage supplied from the grayscale voltage generating circuit 106, and is responsive to the activation of the strobe signal STB from the timing control circuit 105 to drive the data line of the display unit 30 with the signal voltage corresponding to the input image data. The pixel switch, not shown, connected to a gate line selected and activated by the gate line drive circuit 31 which receives a gate start pulse signal from the timing control circuit 105, is turned on, and a grayscale voltage signal from the data line, the pixel switch is connected to, is applied to a display element of the pixel, whereby one horizontal line equivalent of the pixels is displayed. By the same sequel of operations, two pixels of the next horizontal line, output in succession from the shift register circuit 107, are sequentially latched by two latch circuits, associated therewith, so that a grayscale voltage signal, associated with the image data, are output from the data line drive circuits 103 to H data lines. In this manner, the lines selected by the gate line drive circuit 31 are sequentially displayed to display V horizontal lines making up a frame.

In the embodiment shown in FIG. 1, the operation for a case where input image data from the image rendering device 20 is a still image is described. The image data control circuit 108 writes input image data from the memory control circuit 104, as two juxtaposed pixel memory write data in the display memory 101. A horizontal line equivalent of image data, read out from the display memory 101, is supplied in parallel fashion to the set of latch circuits 102.

In case the moving image/still image discriminating signal indicates a still image, the shift register circuit 107 exercises control for activating the H/2 latch signal at a common timing, and outputting the so activated latch signal, based on the latch signal of the latch/shift signal from the timing control circuit 105. The one horizontal line equivalent of the image data, latched by the H latch circuits, is supplied in a parallel fashion to the data line drive circuits 103, so that the first to Hth data lines are driven by the grayscale voltage consistent with the image data. The pixel switch, not shown, connected to a gate line selected and activated by the gate line drive circuit 31, supplied with a gate start pulse signal from the timing control circuit 105, is turned on, and a grayscale voltage signal from the data line, the pixel switch is connected to, is applied to a pixel (display element), whereby a one horizontal line equivalent of the pixels is displayed. By the same sequel of operations, two pixels of the next horizontal line, output in succession from the display memory 101, are sequentially latched by H latch circuits, so that the grayscale voltage signal, associated with the image data from the set of latch circuits, are output from the data line drive circuits 103 to H data lines. In this manner, the lines selected by the gate line drive circuit 31 are sequentially displayed to display V horizontal lines making up a frame.

In the present embodiment, in the two-pixel-based transfer of the write pixel data to the display memory 101, two-pixel-based transfer of read-out image data from the display memory 101 and in the two-pixel-based transfer to the set of the latch circuits, image data are transferred using the divide-by-two clock frequency of transfer clocks of the input image data from the image rendering device 20. The result is that over-drive driving may be effected without increasing the frequency of the transfer cocks.

Also, in the present embodiment, a set of interconnections (data buses) 112 from the display memory 101 to the set of latch circuits 102, used as data transmitting channels when the moving image/still image discriminating signal indicates a still image, is used as data transmitting channels of image data output from the transfer data control circuit 110 to the set of latch circuits 102. In the present embodiment of the configuration, the number of the interconnections to the set of latch circuits 102 is not increased to suppress the chip area from being increased. That is, in the present embodiment, when the moving image/still image discriminating signal indicates a moving image, an output of the transfer data control circuit 110 is connected to the data transfer lines 112, by the switches 111 turned on during the active period of the transfer start signal, to transfer the image data output from the transfer data control circuit 110 via data transfer lines 112 to the set of latch circuits 102. When the moving image/still image discriminating signal indicates a still image, the switches 111 are in the off state, at all times, to isolate the output of the transfer data control circuit 110 from the interconnections 112. As described above, for displaying a still image for the same configuration, the same level of power is maintained, and switching may be made to the over-drive driving only for displaying moving images.

FIG. 1 shows a configuration in which the data line drive circuits 103 actuate the data line with a voltage. However, if the pixels of the display unit are made up of current-driven display elements, the grayscale voltage generating circuit 106 is replaced by a current generating circuit and the H data line drive circuits are configured for driving the corresponding data lines with the driving current consistent with the image data output from the associated latch circuits.

Figure 2:
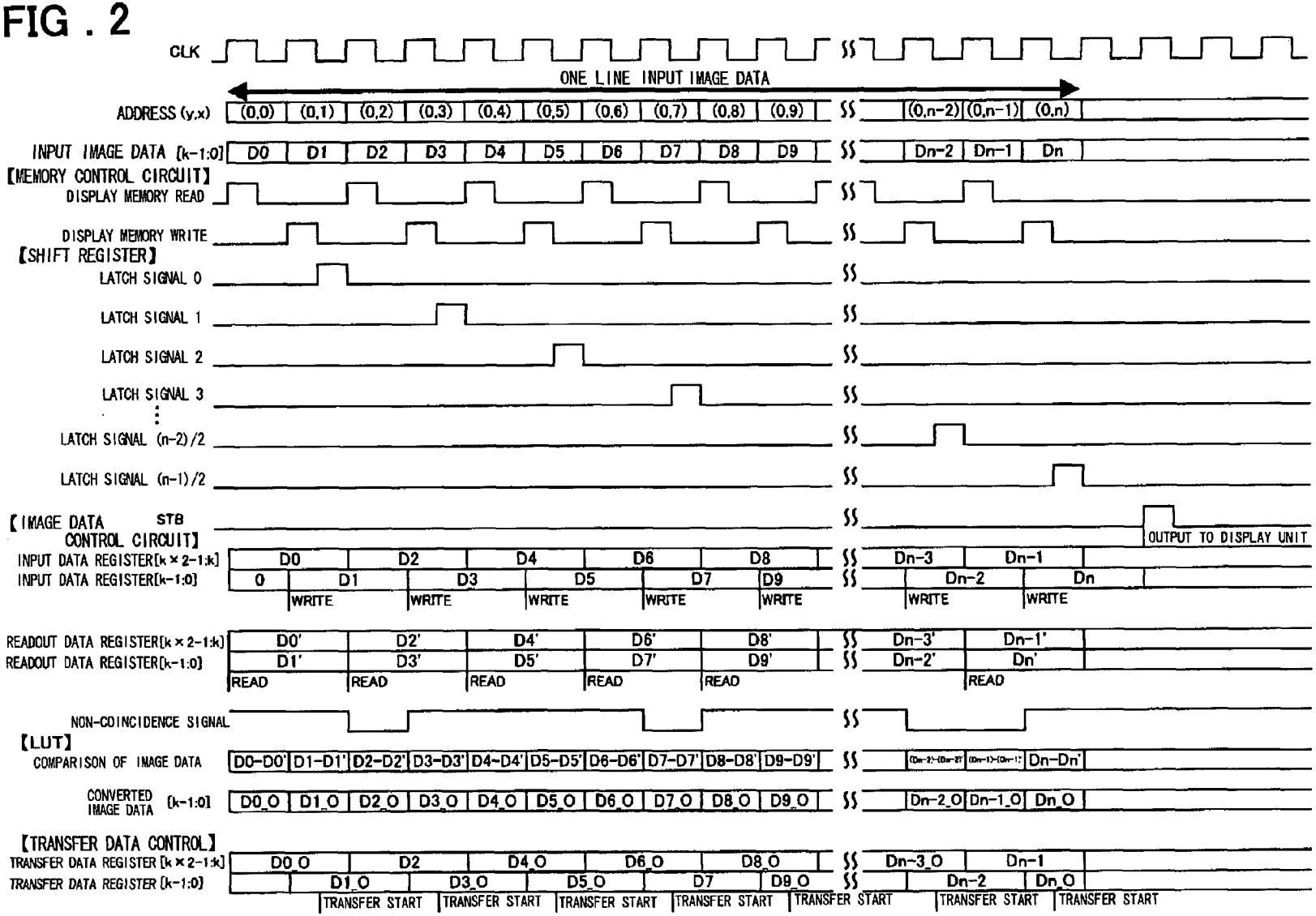
FIG. 2 is a timing chart for illustrating a typical operation of the first embodiment of the present invention.

FIG. 2 is a timing chart for illustrating the operation, in the first embodiment of the present invention shown in FIG. 1, in case the moving image/still image discriminating signal indicates a moving image. In FIG. 2, CLK denotes driving clock signal, and Address denotes a storage address of a display memory for input image data for one line. In FIG. 2, one-line equivalent of input image data has a y-address of 0 and x-addresses from 0 to n. The k-bit input image data are D0 to Dn. Meanwhile, in FIG. 1, one line of the display memory 101 is made up by H pixels, and H is related with n of the addresses from 0 to n of FIG. 2 by H=n+1. The operation of the first embodiment of the present invention will now be explained by referring to FIGS. 1 and 2.

The memory control circuit 104 alternately outputs display memory READ and display memory WRITE, every clock cycle, as a display memory control signal. The memory write image data to the display memory 101 is transferred every two pixels (every k bits×2), in a parallel fashion, while the memory readout image data, read out from the display memory 101, are also transferred every two pixels (every k bits×2), in a parallel fashion, at a transfer rate which is one-half that of the input image data from the image rendering device 20.

The shift register circuit 107 sequentially outputs a latch signal 0, a latch signal 1, . . . , a latch signal (n−2)/2 and a latch signal (n−1)/2=H/2, phase-shifted by two clock cycles from one another, based on a shift signal supplied from the timing control circuit 105 (with a period equal to two clock cycles of the clock signal CLK).

After the latch signal (n−1)/2 (pulse signal) is output from the shift register circuit 107, and image data of one line equivalent (H) of pixels are latched by the set of latch circuits 102, the timing control circuit 105 generates and outputs a strobe signal STB (pulse signal) to send the so generated strobe signal to the set of data line drive circuits 103.

The image data control circuit 108 includes an input data register (1081 in FIG. 3; not shown in FIG. 1), which receives input image data, in terms of a pixel (k bits) as a unit, from the memory control circuit 104, to output two-pixel equivalent of image data (2×k bit width), and a readout data register (1082 in FIG. 3; not shown in FIG. 1), which receives memory readout image data (2×k bit width) from the display memory 101 and storing the data. FIG. 2 shows the transition of the contents of upper k bits [k×2−1: k] and lower k bits [k−1: 0] of the readout data register adapted for storing memory readout image data of the directly previous frame as read out from the display memory 101.

In the input data register [k×2−1: k] and in the input data register [k−1: 0] of the image data control circuit 108, there are stored even and odd input image data every two cycles of the input image data. That is, in the input data register [k×2−1: k], there are stored input image data D0, D2, D4, . . . , Dn−3 and Dn−1, supplied from the memory control circuit 104 to the image data control circuit 108 every two cycles. In the input data register [k−1: 0], there are stored input image data D1, D3, D5, . . . , Dn−2 and Dn, supplied from the memory control circuit 104 to the image data control circuit 108 every two cycles. I Two pixels of image data of the upper k bits [k×2−1: k] and the lower k bits [k−1: 0] of the input data register of the image data control circuit 108 are written in the display memory 101, in accordance with the display memory control signal WRITE (activated state at a high level) activated every two clock cycles.

That is, from the input data registers [k×2−1: k], [k−1: 0] of the image data control circuit 108, D0 and D1 are transferred as k bits×2 memory write image data and, responsive to the display memory control signal WRITE in the activated state, D0 and D1 are written in associated addresses (0, 0) and (0, 1) of the display memory 101. Then, from the input data registers [k×2−1: k], [k−1: 0] of the image data control circuit 108, D2 and D3 are transferred as k bits×2 memory write image data and, responsive to the display memory control signal WRITE in the activated state, D2 and D3 are written in associated addresses (0, 2) and (0, 3) of the display memory 101. In similar manner, a two-pixel equivalent of the image data Dn−1 and Dn are transferred from the input data register to the display memory 101 and written in associated addresses (0, n−1), (0, n) of the display memory 101, responsive to the display memory control signal WRITE in the activated state.

In the upper k bits [k×2−1: k] and the lower k bits [k−1: 0] of the readout data register of the image data control circuit 108, there are simultaneously stored two pixels of the memory readout image data, read out from the display memory 101 in accordance with the display memory control signal (activated in the high level) activated every two cycles of the clock signal CLK. That is, in the upper k bits [k×2−1: k] and the lower k bits [k−1: 0] of the readout data register, there are sequentially stored two pixels of the memory readout image data D0', D1'; D2', D3'; . . . , Dn−3', Dn−2'; Dn−1', and Dn'.

In the present embodiment, the activation timing of the display memory control signal READ and that of the display memory control signal WRITE are shifted from each other by one clock cycle of the clock signal CLK. That is, responsive to the display memory control signal READ in the activated state, two pixels D0 and D1 of the memory write image data are written from the input data registers of the image data control circuit 108 in the addresses (0, 0) and (0, 1). The two pixels D0' and D1' of the memory readout image data are image data of the memory write image data D0 and D1 of the directly previous frame. In similar manner, after reading out two pixels D2' and D3' of the memory readout image data from the addresses (0, 2) and (0, 3) of the display memory 101, two pixels D2 and D3 of the memory write image data are written in the addresses (0, 2) and (0, 3) and, after reading out two pixels D(n−1') and Dn' of the memory readout image data from the addresses (0, n−1) and (0, n) of the display memory 101, two pixels Dn−1, and Dn of the memory write image data are written in the addresses (0, n−1) and (0, n).

The image data control circuit 108 includes a detection circuit, not shown, for verifying whether the input image data and image data one frame before of the input image data are non-coincident or coincident with each other, and outputs the result of decision as a non-coincidence signal. The non-coincidence signal is at a high level or at a low level for indicating non-coincidence and coincidence, respectively.

The timing diagram shown in FIG. 2 shows a case where the input image data D2 stored in the input data register of the image data control circuit 108—image data D2' one frame before, held in the readout data register, the input image data D7' image data one frame before D7', the input image data D n−2' image data one frame before Dn−2' and the input image data D n−1' image data one frame before Dn−1', are coincident with one another, with the low level indicating non-coincidence. The lookup table (LUT) 109 outputs converted image data from the input image data and image data of the directly previous frame. The lookup table outputs converted image data D0_O, D1_O, . . . , Dn−1_O, and Dn_O against paired input image data—image data of the directly previous frame (D0-D0'), (D1-D1'), (D2-D2'), (Dn−1_Dn−1'), and (Dn_Dn'). The lookup table 109 is run every clock cycle.

The transfer data control circuit 110 includes (k bits×2) transfer data registers, not shown, and stores the converted image data or the input image data in the transfer data register in case the non-coincidence signal indicates non-coincidence (low level) or coincidence (high level), respectively. When the transfer start signal from the memory control circuit 104 is activated, the (k bits×2) image data, corresponding to two pixels, of the transfer data register in the transfer data control circuit 110, are sent out to the set of latch circuits 102 via on-state switches.

In the case of FIG. 2, even and odd image data D0_O and D1_O are stored in the upper bits [k×2−1: k] and the lower bits [k−1: 0] of the transfer data register, respectively, such that, when the transfer start signal, output from the memory control circuit 104, is activated, the switches 111 are turned on to send the D0$_{_O\ and\ D1}$_O to the set of latch circuits 102. Then, even and odd image data D2 (input image data), and D3_O (converted image data) are stored in the upper bits [k×2−1: k] and the lower bits [k−1: 0] of the transfer data register, respectively, such that, when the transfer start signal, output from the memory control circuit 104, is activated, the switches 111 are turned on to send the D2 and D3_0 to the set of latch circuits 102. In similar manner, even and odd image data Dn−1 and Dn_O are stored in the upper bits [k×2−1: k] and the lower bits [k−1: 0] of the transfer data register, respectively, such that, when the transfer start signal, output from the memory control circuit 104, is activated, the switches 111 are turned on to send the Dn−1 and Dn_O to the set of latch circuits 102. Two pixels of the image data from the transfer data control circuit 110 are transferred over an interconnection (data bus) 112 to the set of latch circuits 102 through the switches 111 which are turned on in case the display memory control signal supplied from the memory control circuit 104 to the display memory 101 (display memory READ signal or display memory WRITE signal) is not activated, that is, in case readout from or writing to the display memory 101 is not carried out. During readout from or writing to the display memory 101 under control by the memory control circuit 104, the switches 111 are turned off, so that the output of the transfer data control circuit 110 is disconnected from the interconnections 112. That is, in the present embodiment, the operation of converting the pixel data by the lookup table 109 is carried out simultaneously with the readout and write operations for two pixels of the image data from the display memory 101. The as-converted pixel data are transferred to the set of latch circuits 102 and latched by the relevant latch circuits during the time the display memory 101 is not accessed.

Figure 3:
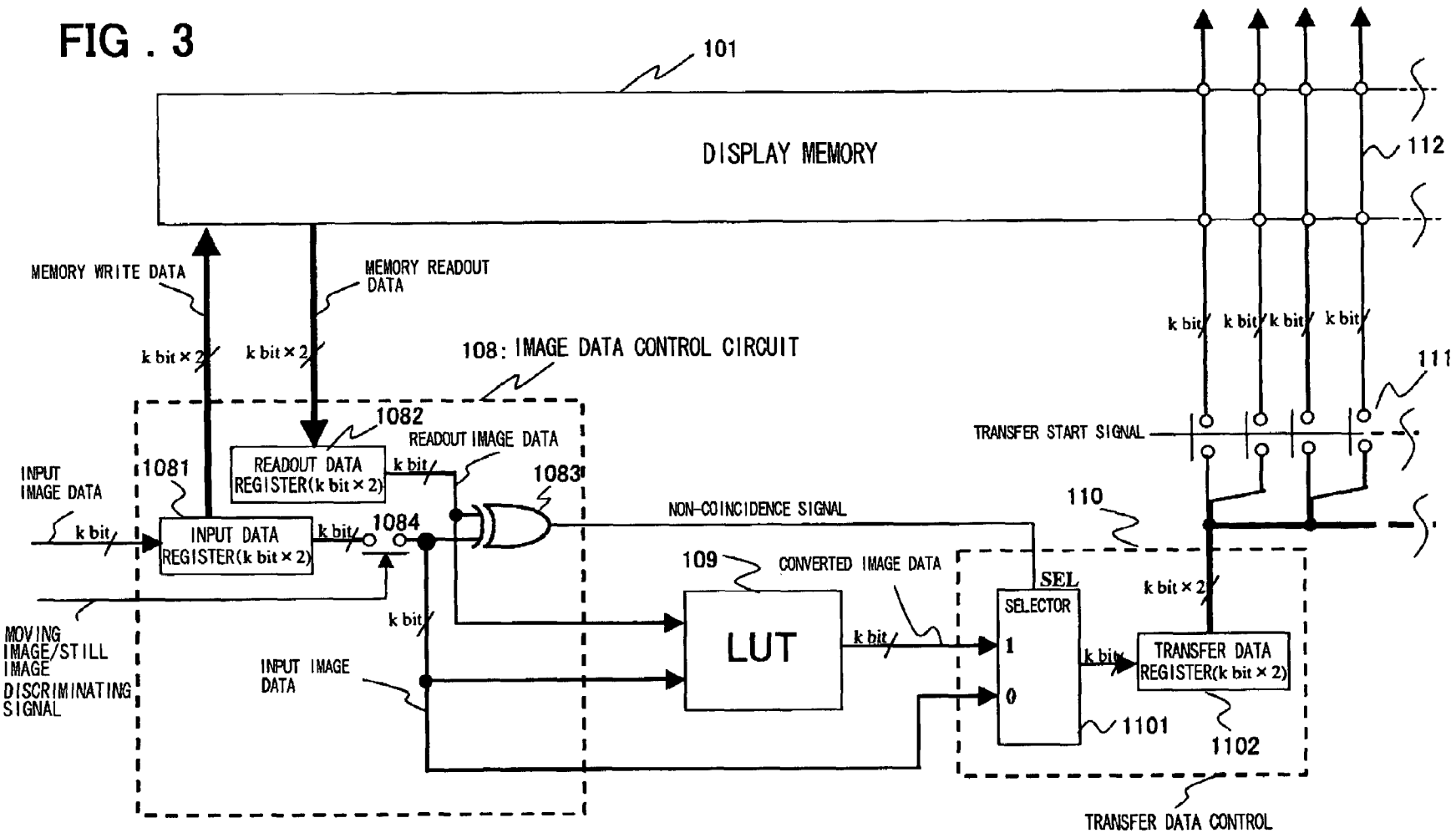
FIG. 3 is a diagram showing the circuit configuration in the vicinity of a LUT in the first embodiment of the present invention.

FIG. 3 illustrates the configuration of the image data control circuit 108 and the transfer data control circuit 110 shown in FIG. 1.

Referring to FIG. 3, the image data control circuit 108 includes an input data register 1081, a readout data register 1082, a non-coincidence detection circuit 1083, made up by an Ex-OR circuit, outputting a logic 1 in case of non-coincidence, and a switch 1084.

The input data register 1081 stores two-pixel memory readout image data from the switch 1084 in a parallel fashion and outputs the data as memory write data. The input data register 1081 also outputs image data (k bits).

The non-coincidence detection circuit 1083 receives the two-pixel memory readout image data, read out from the display memory 101 (data one frame before the image data stored in the input data register 1081) to sequentially output the image data (k bits). The switch 1084 is turned on when the moving image/still image discriminating signal indicates moving images.

The non-coincidence detection circuit 1083 compares the input image data from the switch 1084 to the readout image data from the readout data register 1082 (image data one frame before the input image data) and outputs a low level and a high level in case of non-coincidence and coincidence, respectively.

The input image data from the input data register 1081 (output of the switch 1084) and the image data from the readout data register 1082 (readout image data one frame before the input image data) are sent to the lookup table 109.

When the moving image/still image discriminating signal indicates moving images and a still image, the switch 1084 is turned on and off, respectively.

The transfer data control circuit 110 includes a selector 1101, supplied with the converted image data (k bits), output from the lookup table 109, and with input image data from the input data register 1081 (output of the switch 1084) to output a non-coincidence signal as a selection control signal, and a transfer data register 1102, supplied with an output of the selector 1101 to hold two pixels of the image data.

The two-pixel image data, output from the transfer data register 1102 (k bits×2), is supplied from the interconnections 112 to the set of latch circuits 102 via switches 111 which are turned on during the time of activation of the transfer start signal output from the memory control circuit 104.

Figure 4:
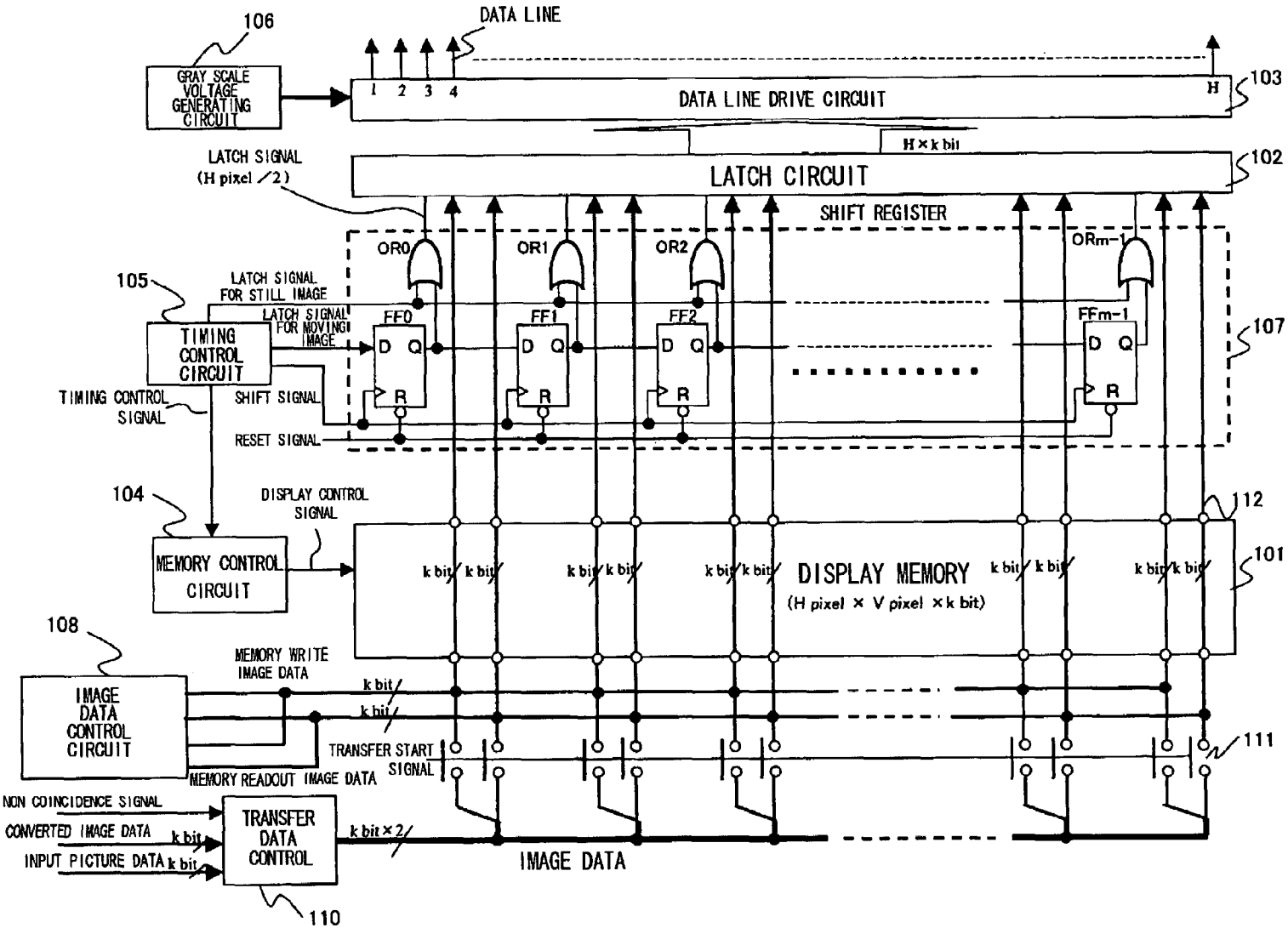
FIG. 4 is a diagram showing the configuration of a shift register in the first embodiment of the present invention.

FIG. 4 mainly shows the configuration of the shift register circuit 107 of the first embodiment of the present invention.

Referring to FIG. 4, the shift register circuit 107 includes cascade-connected D-flip-flops FF0 to FFm−1, each having a resetting function, and having a clock input terminal supplied common with a shift signal from the timing control circuit 105, and two-input OR circuits OR0 to OR m−1, mounted in association with the D-flip-flops FF0 to FFm−1, and having one input terminals connected to data output terminals Q of the associated D-flip-flops and having the other input terminals supplied common with a latch signal for still image from the timing control circuit 105. The data input terminal D of the initial-stage D-flip-flop FF0 receives a latch signal for moving images (high level in case of moving images) output from the timing control circuit 105. This latch signal for moving images is sampled by the D-flip-flop FF0 with e.g. the rise edge of the shift signal and output from the data output terminal Q thereof (the data output terminal Q of the flip-flop FF0 transferring from the low level to the high level. The latch signal for moving images is then transferred sequentially through the D-flip-flops FF0 to FFm−1, with the rise edge of the shift signal, so that the data output terminals Q of the D-flip-flops FF0 to FFm−1 sequentially transfer from the low level to the high level.

In case the latch signal for the still image is at a low level (moving images), the OR circuits OR0 to OR m−1 transmit outputs of the D-flip-flops FF0 to FFm−1 to the set of latch circuits 102.

For a still image, the set of latch circuits 102 is responsive to transition from the low level to the high level of latch signal for still images, output from the timing control circuit 105, to latch one line equivalent of image data from the display memory. In case the latch signal for the still image is at a high level, the OR circuits OR0 to OR m−1 mask the data output terminals of the D-flip-flops FF0 to FFm−1. For the still image, the latch signal for moving images from the timing control circuit 105 is at a low level. For moving images, a reset signal from the timing control circuit 105 is used e.g. before starting the scanning for one horizontal line.

The two pixels of the memory readout image data (k bits× 2), read out from the display memory 101, are supplied in parallel fashion to the readout data register 1082 of the image data control circuit 108 (see FIG. 3), under control by the memory control circuit 104. The two pixels of the memory write image data (k bits×2), supplied from the input data register 1081 of the image data control circuit 108 (see FIG. 3) in a parallel fashion to associated addresses of the display memory 101, under control by the memory control circuit 104. In this case, the memory write image data are written in the same address as that of the image data of the directly previous frame read out directly previously. The switches 111 are turned off during readout from and writing to the display memory 101. Meanwhile, in the configuration shown in FIG. 4, output ports and input ports are provided on the sides of the display memory 101 facing the set of latch circuits 102 and those facing the set of latch circuits 102, respectively, and the output and input ports are connected to associated interconnections (data buses) 112.

In case the frame picture displayed is a still image, a relevant one-line equivalent of image data is supplied from the output ports of the display memory 101 from the interconnections 112 to the set of latch circuits 102, in a parallel fashion. The set of latch circuits 102 latch the image data signal (k bits) output from the output ports of the display memory 101, in a parallel fashion, with the rise edge of the latch signal for the still image, as previously explained.

In case the frame picture displayed is a moving image, two pixels of image data (k bits×2), output from the transfer data control circuit 110, are supplied common to the input end of the set of latch circuits 102 (H latch circuits), through the H switches 111, turned on by the activated transfer start signal, and H interconnections 112, so as to be latched by two latch circuits, associated with the first and second data lines, by the rising edge of an output signal of the OR circuit OR0 (latch signal 0).

Then, two pixels of image data (k bits×2), output from the transfer data control circuit 110, are supplied common to the input end of the set of latch circuits 102 (H latch circuits), through the H switches, turned on by the activated transfer start signal, and H interconnections 112, so as to be latched by two latch circuits, associated with the third and fourth data lines, by the rising edge of an output signal of the OR circuit OR1 (latch signal 1). In similar manner, two pixels of image data are latched with the rising edge of an output signal of the OR circuit ORm−1, by two latch circuits associated with the (H−1)st and Hth data lines. With the present embodiment, described above, the readout/write operations of the display memory 101 are carried out every preset plural number of pixels, herein every two pixels, even in case the frame picture displayed is a moving image. The operation of conversion into pixels is executed simultaneously with the readout/write operation for the display memory 101 and image data are transferred to the set of latch circuits 102 during the time the display memory 101 is not accessed, with the result that the over-drive driving can be performed without raising the clock rate.

If, in the first embodiment of the present invention, the picture displayed is a moving image, the image data of the directly previous frame are not accumulated for the picture of the first frame. Hence, the frame may be stored in the display memory 101 and sent from the display memory 101 to the set of latch circuits 102. In the present embodiment, when the image data output from the transfer data control circuit 110 is supplied to the set of latch circuits 102, the H switches in their entirety are turned on by the transfer start signal from the memory control circuit 104. Alternatively, only the switches for image data latched by the latch circuits, instead of the entire switches, may be turned on to shift the transfer start signal.

The operation and meritorious effect of the present invention will now be described. With the first embodiment, in which the current image data are written in the display memory 101 every preset number of pixels, it is possible to suppress moving images from becoming blurred, while it is also possible to suppress the increase in the number of times of accessing the display memory 101.

Moreover, in the present embodiment, the interconnections (data buses) 112 used for transferring image data from the display memory 101 to the set of latch circuits 102, are used for transferring image data converted for over-drive driving to the set of latch circuits 102, the over-drive driving can be achieved without increasing the number of interconnections.

In addition, in the present embodiment, the control mode of the controller driver 10 can be variably controlled for displaying a still image and for displaying moving images, based on the moving image/still image discriminating signal, entered from the image rendering device (CPU) 20 to the controller driver 10, whereby it is possible to select optimum driving for each of the still image display operation and the moving image display operation.

Figure 5:
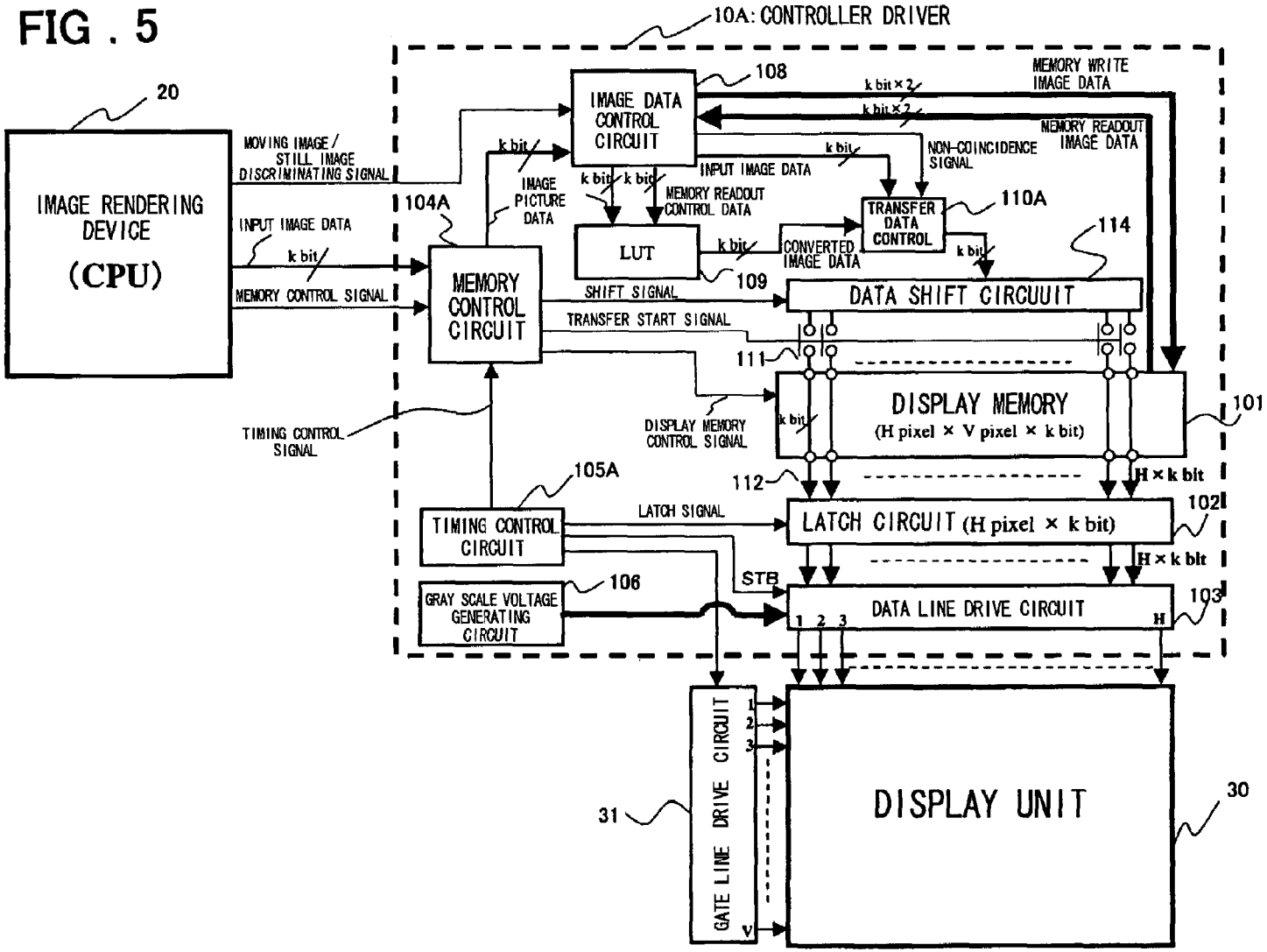
FIG. 5 is a diagram showing the overall configuration of a second embodiment of the present invention.

A second embodiment of the present invention will now be described. FIG. 5 shows the configuration of the second embodiment of the present invention. In FIG. 5, the same parts or components as those shown in FIG. 1 are depicted by the same reference numerals. In the following, only the points of difference of the present second embodiment from the first embodiment shown in FIG. 1 are explained.

Referring to FIG. 5, the second embodiment of the present invention includes a data shift circuit 114 receiving and shifting an output from a transfer data control circuit 110A, however, the shift register circuit 107 of FIG. 1 is omitted. A set of switches 111 are provided between outputs of the data shift circuit 114 and the data transfer lines 112. In the second embodiment of the present invention, the transfer data control circuit 110A outputs k-bit image data (data for one pixel) to supply the data to the data shift circuit 114, which data shift circuit 114 receives a shift signal from a memory control circuit 104A to sequentially shift the input image data. When one-line equivalent of the image data are stored, the memory control circuit 104A activates the transfer start signal to turn on the switches 111 to send the one line image data (H data) to the set of latch circuits 102. The H latch circuits, forming the set of latch circuits 102, latch the image data by a common latch signal from a timing control circuit 105A to send the so latched signal to the set of data line drive circuits 103. That is, in the above-described first embodiment, in case the picture displayed is the moving image, the latch signal, supplied by the set of latch circuits 102, is shifted by the shift register and output. In the present embodiment, a common latch signal is supplied to the H latch circuits of the set of latch circuits 102.

Figure 6:
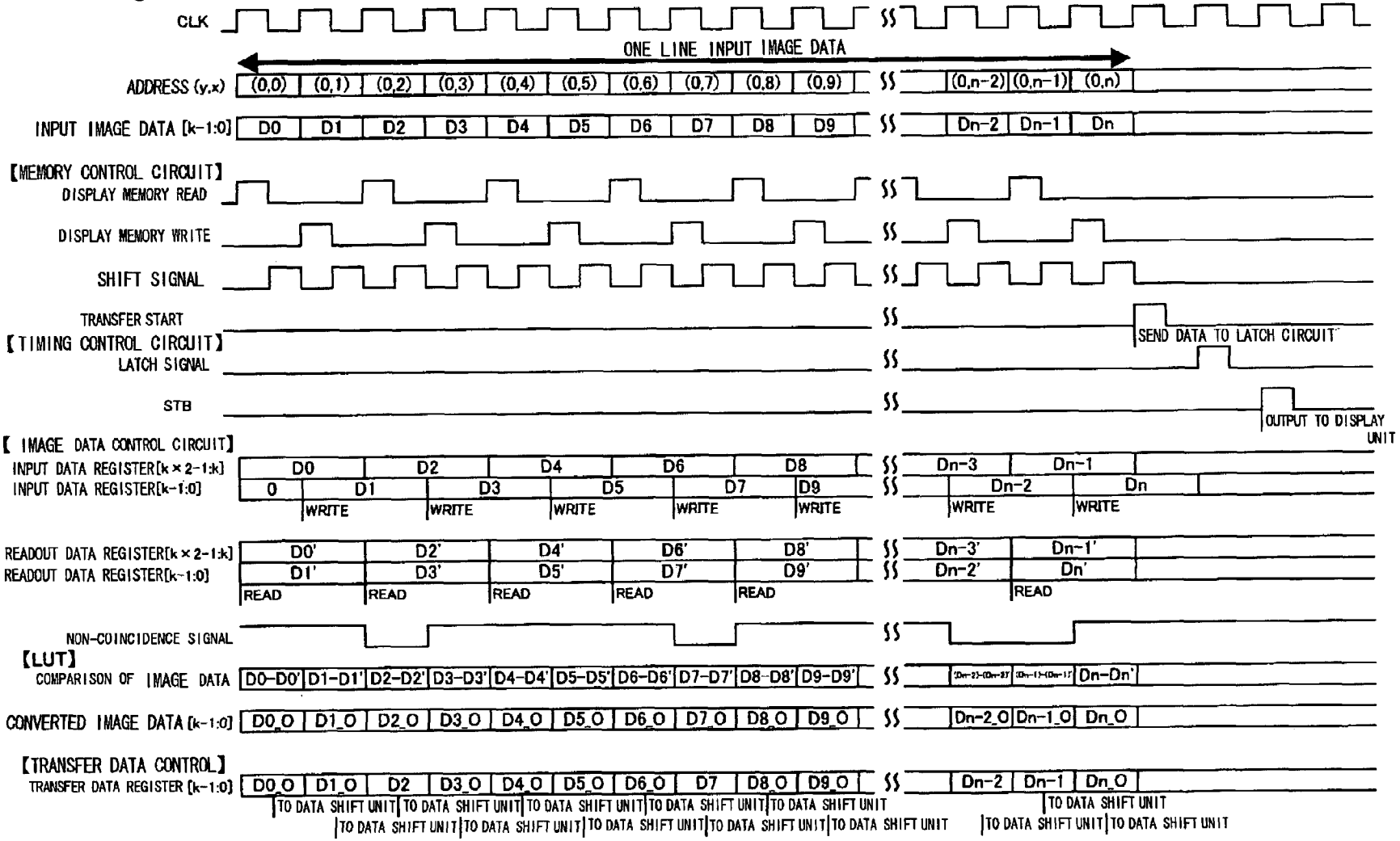
FIG. 6 is a timing chart for illustrating a typical operation of the second embodiment of the present invention.

FIG. 6 is a timing diagram for illustrating the operation of the second embodiment of the present invention. In this figure, CLK, Address and input image data have the same meaning as that shown in FIG. 2.

The memory control circuit 104A outputs READ and WRITE, as memory control signal for display, with a period of two clocks, as in the first embodiment described above. In the present embodiment, the memory control circuit 104A outputs a shift signal and a transfer control signal. The timing control circuit 105A outputs a common latch signal for H latch circuits.

The operation of the image data control circuit 108 and the lookup table 109 is the same as that described above with reference to FIG. 2.

A transfer data control circuit 110A sends k-bit transfer data to the data shift circuit 114, which data shift circuit 114 sequentially shifts the input transfer data (image data) based on the shift signal supplied from the memory control circuit 104A, so that one line equivalent of the image data are stored.

In the case shown in FIG. 6, input image data D2, for example, is the same as image data D2' of the directly previous frame. Thus, the non-coincidence signal is at a low level, and input image data D2 is output from the transfer data control circuit 111A.

Figure 7:
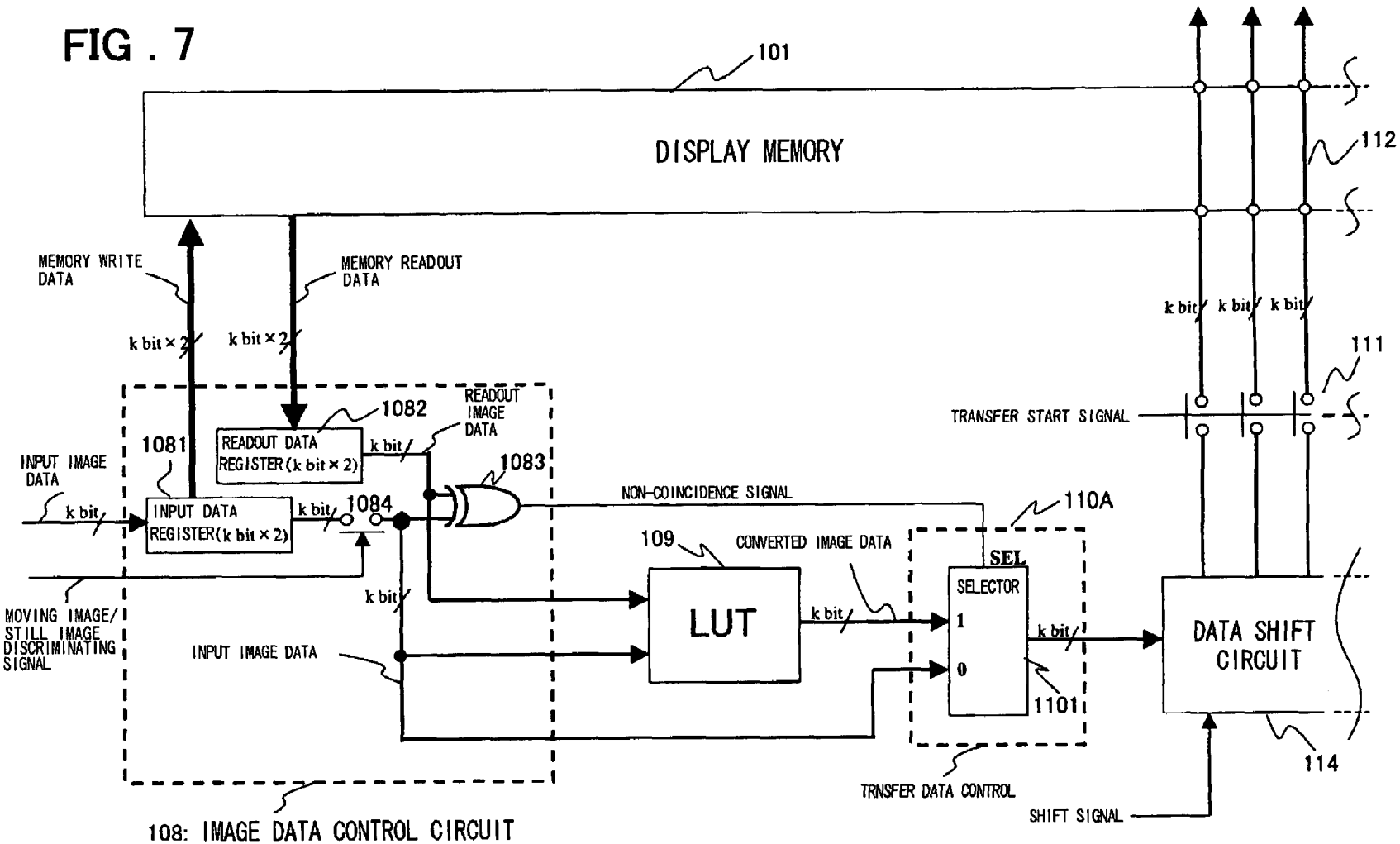
FIG. 7 is a diagram showing the circuit configuration in the vicinity of a LUT in the second embodiment of the present invention.

FIG. 7 shows the configuration of the image data control circuit 108 and the transfer data control circuit 110A. Referring to FIG. 7, the image data control circuit 108 is of the same configuration as the corresponding circuit shown in FIG. 3.

On the other hand, the transfer data control circuit 110A includes only the selector 1101, in distinction from the first embodiment shown in FIG. 3. That is, the selector 1101 receives a non-coincidence signal from the image data control circuit 108, as a selection control signal and, if the non-coincidence signal indicates non-coincidence, the transfer data control circuit selects an output of the lookup table 109 (converted image data) to send the so selected output to the data shift circuit 114. If the non-coincidence signal indicates non-coincidence, the transfer data control circuit selects an output of the input image data from the switch 1084 to send the so selected output to the data shift circuit 114.

Figure 8:
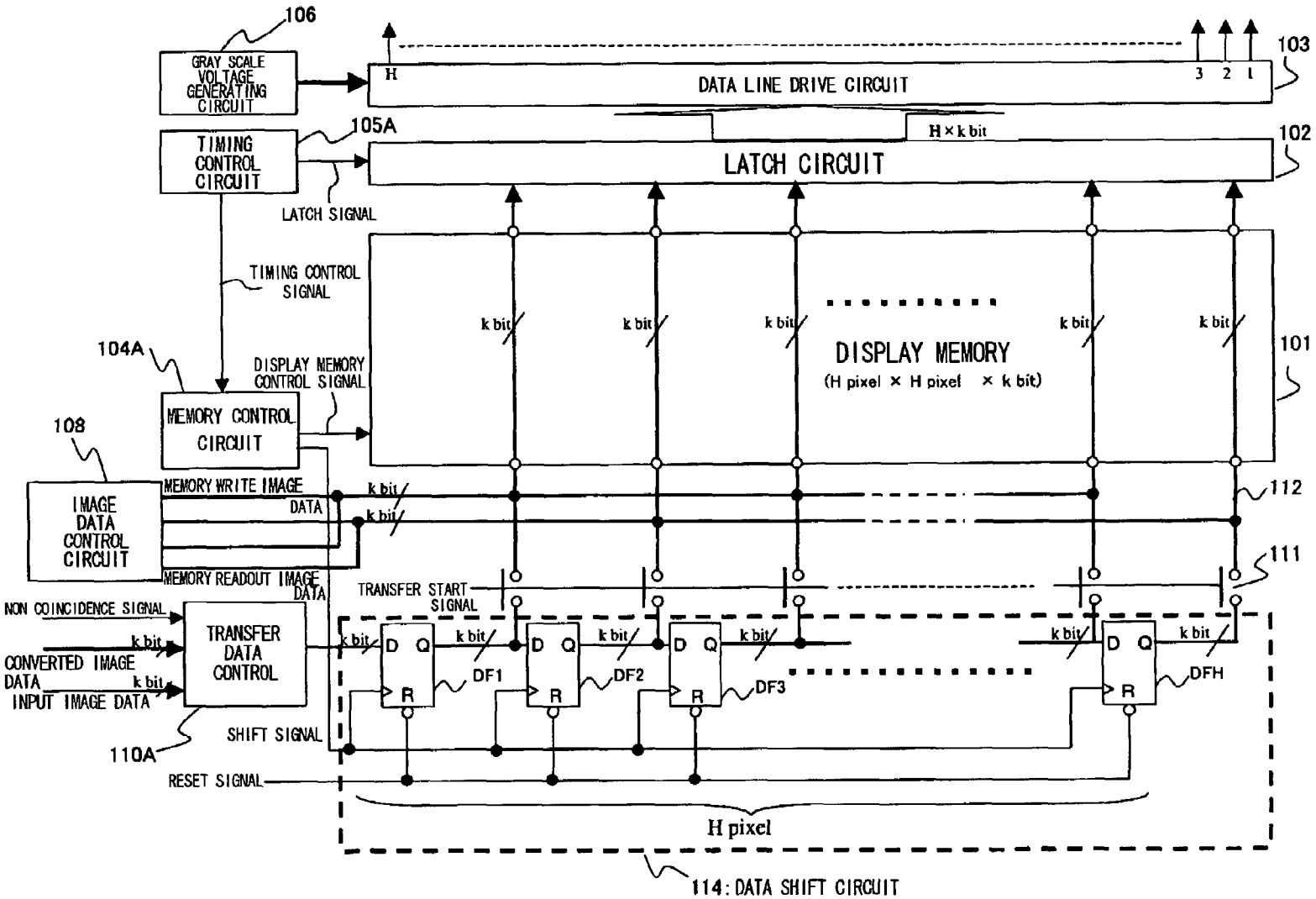
FIG. 8 is a diagram showing the configuration of a data shift circuit in the second embodiment of the present invention.

FIG. 8 shows a detailed configuration centered about the configuration of the data shift circuit 114 of the second embodiment. In FIG. 8, the data shift circuit 114 is made up by H cascaded stages of flip-flops DF1 to DFH. By a shift signal, image data from the transfer data control circuit 110A are sequentially transferred from the first-stage flip-flop DF1.

The image data to be supplied to the set of latch circuits of the first data line are entered to the flip-flop DF1 and get to the flip-flop DFH by H shift signal. At this time, the image data to be supplied to the latch circuit of the Hth data line is sampled by the flip-flop DF1.

In the second embodiment of the present invention, the operation and the meritorious effect similar to those of the above-described first embodiment may be achieved.

Figure 9:
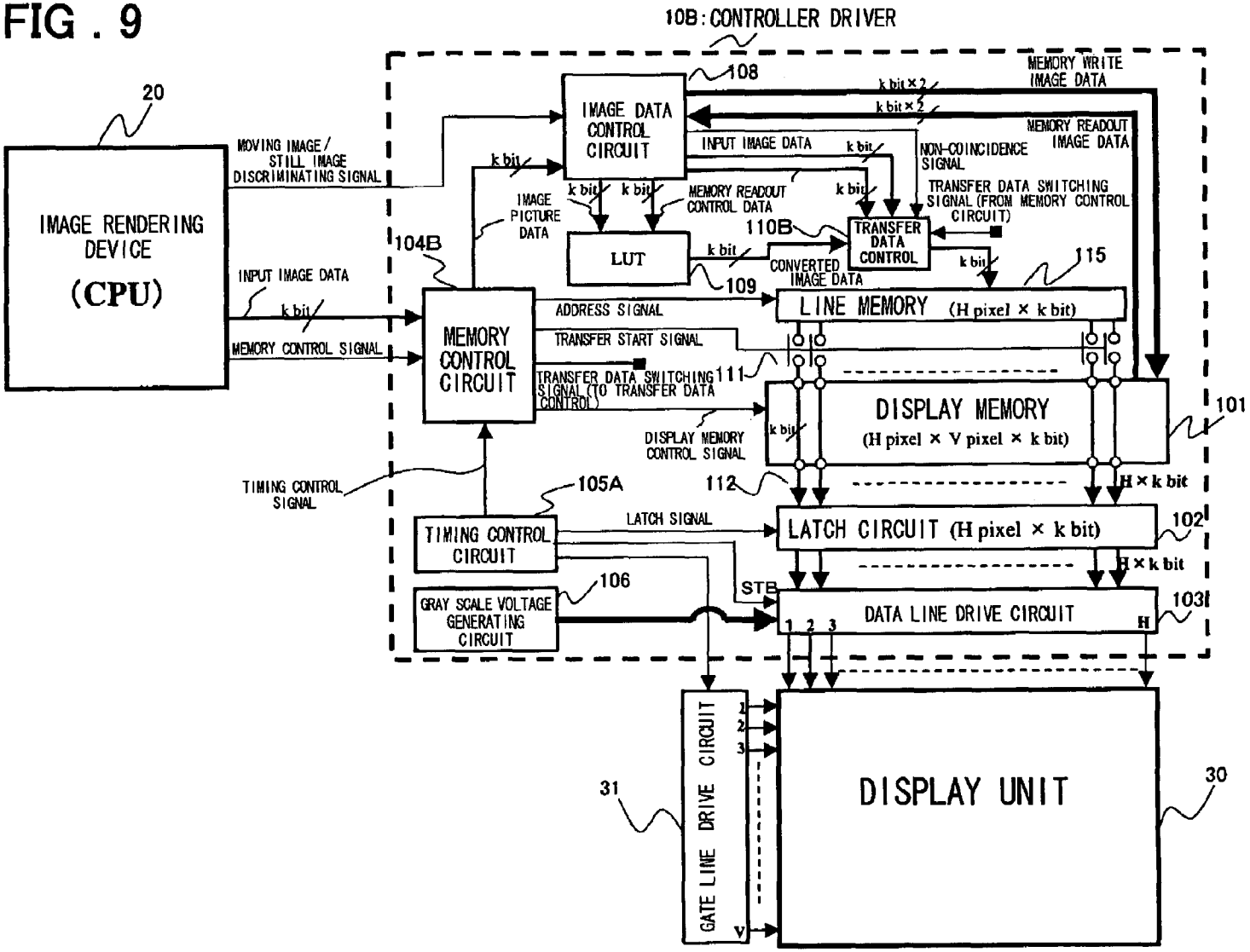
FIG. 9 is a diagram showing the overall configuration of a third embodiment of the present invention.

A third embodiment of the present invention will now be explained. FIG. 9 shows the configuration of the third embodiment of the present invention. Referring to FIG. 9, the third embodiment of the present invention includes, in place of the data shift circuit of the second embodiment, a line memory 115 for storage of one-line equivalent of the image data. In other respects, the configuration of the third embodiment is roughly the same as that of the above-described second embodiment. However, there are such points of difference that a memory control circuit 104B generates and outputs an access address (line memory address) of the line memory 115 and that a transfer data switching signal is supplied to a transfer data control circuit 110B. This transfer data control circuit 110B operates on receipt of a transfer data switching signal from the memory control circuit 104B. In the third embodiment of the present invention, the memory control circuit 104B generates a transfer data switching signal by the address data transferred along with address data from the image rendering device 20. For other than the input image data, transferred from the image rendering device 20, with the transfer data switching signal indicating an inactivated state, control is managed for substituting the input image data for image data one frame before.

Figure 10:
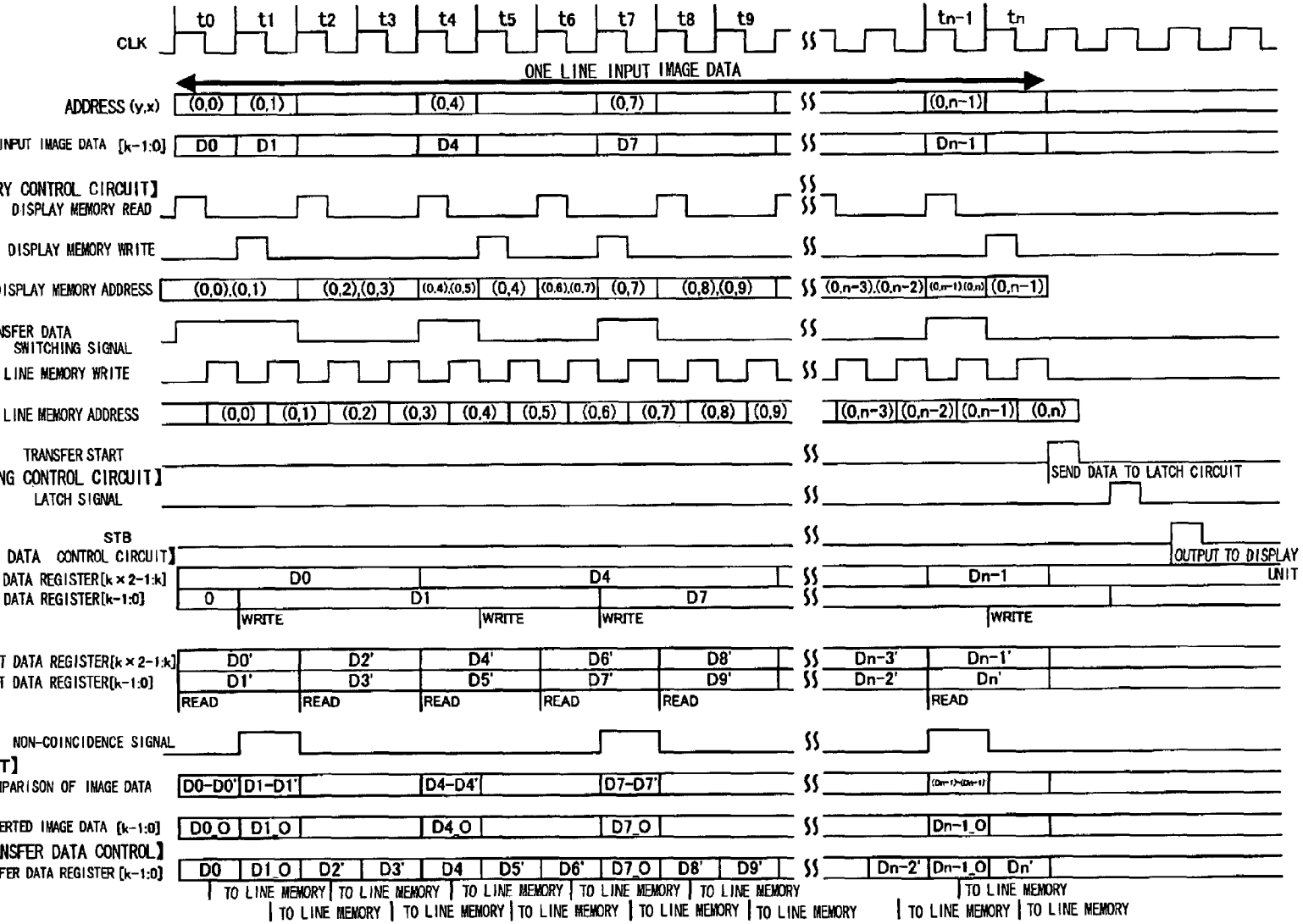
FIG. 10 is a timing chart for illustrating a typical operation of the third embodiment of the present invention.

FIG. 10 depicts a timing diagram showing a typical operation of the third embodiment of the present invention. In the case shown in FIG. 10, input image data D0, D1, D4, D7 and Dn−1 from the image rendering device 20 are supplied to the controller driver 10B for clock cycles t0, t1, t4, t7 and tn−1, however, no input image data is supplied for clock cycles t2, t3, t5, t6, t8, t9 and tn, with the transfer data switching signal then being at a low level. The input image data D0, D1, D4, D7 and Dn−1, transferred when the transfer data switching signal is at a high level, are data to be written at the addresses (0, 0), (0, 1), (0, 4), (0, 7) and (0, n−1), respectively.

The memory control circuit 104B outputs two clock cycles of the READ and WRITE signal, as a display memory control signal, with a phase shift of two clock cycles. The memory control circuit 104B transfers a transfer data switching signal to the transfer data control circuit 110B.

When the transfer data switching signal is at a high level, the transfer data control circuit 110B selects the converted image data from the lookup table 109 or the input image data from the image data control circuit 108, depending on the non-coincidence signal, and outputs the so selected data in terms of one pixel image data as a unit. When the transfer data switching signal is at a low level, the transfer data control circuit 110B outputs memory readout image data, supplied from the image data control circuit 108, to the line memory 115.

The memory control circuit 104B sends a line memory WRITE signal and a line memory address to a line memory, while sending the transfer start signal to the switches 111. The memory control circuit 104B also controls the transfer of the image data, output from the line memory 115, to the set of latch circuits 102.

In association with the activated READ signal of the display memory, from the memory control circuit 104B, addresses [(0,0), (0,1)], [(0,2), (0,3)], [(0,4), (0,5)], [(0,6), (0,7)], [(0,8), (0,9)], . . . , [(0, n−3), (0, n−2)], [(0, n−1), (0,n)] are sequentially output, every two-pixel image data, as a readout address. In case the transfer data switching signal is at a high level, two-pixel memory write image data, transferred from the image data control circuit 108, are written in the address from which the two-pixel image data were read out. If the transfer data switching signal is at a low level, no input image data from the image rendering device 20 are supplied to the controller driver 10B and hence the display memory WRITE signal is not output. When the transfer data switching signal is at a high level, the memory control circuit 104B outputs display memory addresses (0,4), (0,7) and (0, n−1), matched to the input image data, and input image data D4, D7 and Dn−1 are written pixel by pixel in the relevant addresses.

In the image data control circuit 108, readout image data D0', D1', D2', D3' are sequentially stored in the readout data registers [2k−1: k], [k−1: 0] every two clock cycles. If the transfer data switching signal is at a high level, the input image data D0, held in the input data register [2k−1: k], is compared to the readout image data D0' of the directly previous frame, stored in the readout data register [2k−1: k]. In this case, the result of comparison indicates coincidence (the non-coincidence signal is a low level signal). Hence, the input image data D0 is supplied from the transfer data control circuit 110B, as k-bit transfer data, to the line memory 115, so as to be written in the address (0,0) of the line memory 115.

In the next clock cycle, the input image data D1, held in the input data register [k−1: 0], is compared to the readout image data D1' of the directly previous frame, held in the readout data register [k−1: 0]. In this case, the result of comparison indicates non-coincidence. Thus, the converted image data D1_0 is selected from the transfer data control circuit 110B, and supplied as k-bit transfer data to the line memory 115 so as to be written in the address (0,1) of the line memory 115.

Then, in a cycle t2, the transfer data switching signal goes low. The transfer data control circuit 110B sequentially transfers the readout image data D2', D3' of the readout data registers [2×k−1: k], [k−1: 0] as k-bit transfer data to the line memory 115 for storage in the addresses (0,2), (0,3) of the line memory 115 (cycles t2 and t3). At this time, the input data registers [2×k−1: k], [k−1: 0] hold the previous values D0, D1, respectively.

Then, in a cycle t4, the transfer data switching signal again goes high. The input image data D4 from the image rendering device 20 is stored in the input data register [2×k−1: k] of the image data control circuit 108, and the input image data D4 is compared to the readout image data D4' of the directly previous frame, as held in the readout data register [2×k−1: k]. In this case, the non-coincidence signal is at a low level (the input image data coincides with the image data of the directly previous frame). Hence the transfer data control circuit 110B outputs the input image data D4, as transfer data, to write the data in the address (0,4) of the line memory 115.

Then, in a cycle t5, the transfer data switching signal goes low, so that no input image data are sent from the image rendering device 20 and previous data D4, D1 are held in the input data registers [2×k−1: k], [k−1: 0] of the image data control circuit 108. The transfer data control circuit 110B outputs readout image data D5' of the readout data register [k−1: 0] of the image data control circuit 108 as transfer data to write the data in the address (0,5) of the line memory 115. The above sequence of operations is carried out for the subsequent addresses, such that, when the transfer data switching signal is at a low level, the readout image data of the directly previous frame, as held in the readout data register of the image data control circuit 108, is supplied to the line memory 115, whereas, when the transfer data switching signal is at a high level, the converted image data or the input image data is sent to the line memory 115.

Figure 11:
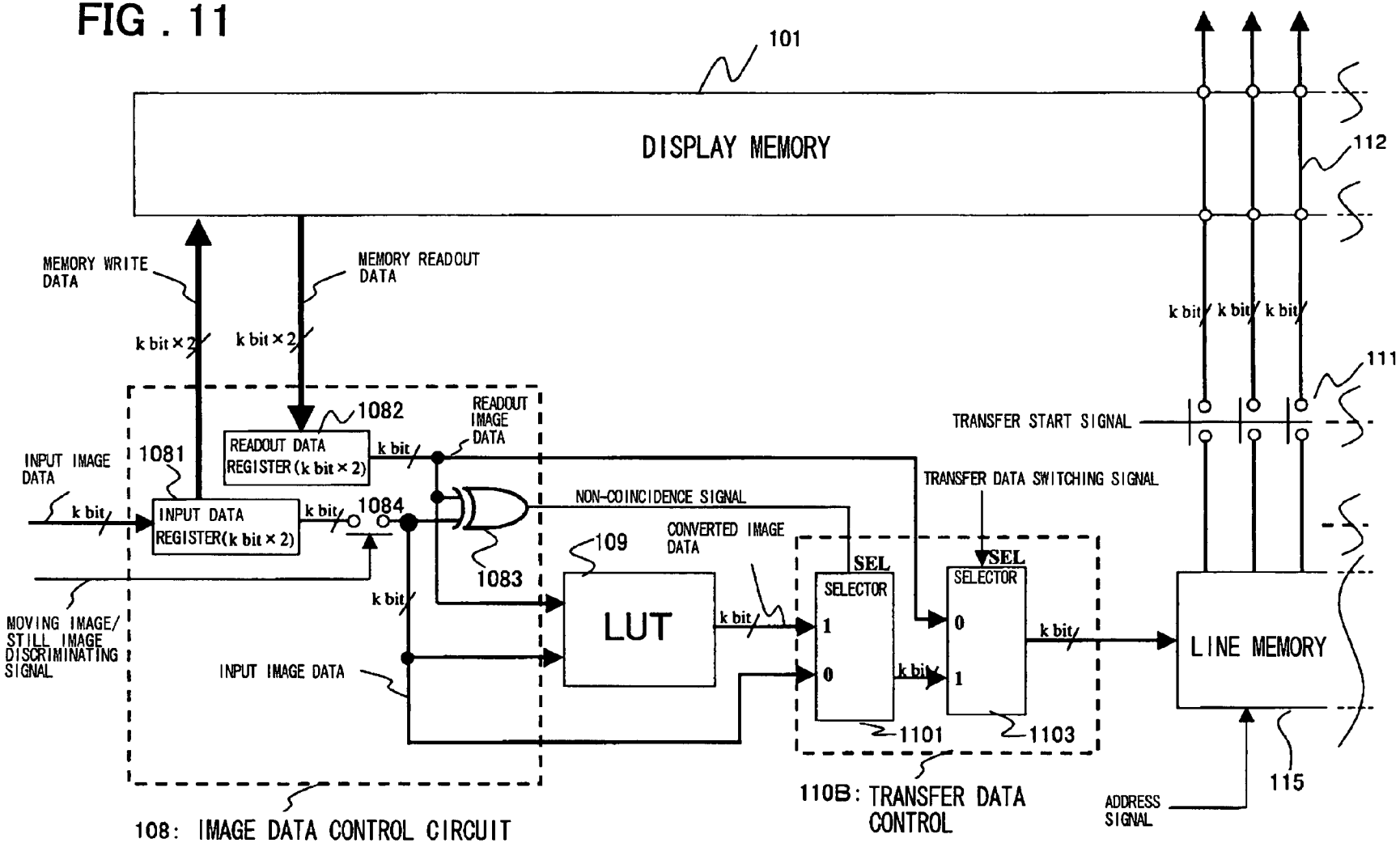
FIG. 11 is a diagram showing the circuit configuration in the vicinity of a LUT in the third embodiment of the present invention.

FIG. 11 shows the configuration of the image data control circuit 108, lookup table 109 and the transfer data control circuit 110B in the third embodiment of the present invention.

Referring to FIG. 11, the image data control circuit 108 is similar in configuration to the corresponding circuit shown in FIG. 7. The transfer data control circuit 110B includes a first selector 1101, which receives an output of the lookup table 109 and input image data from the switch 1084, and receives the non-coincidence signal, as selection control signal, and a second selector 1103, which receives an output of the first selector 1101 and readout image data from the readout data register 1082, and receives the transfer data switching signal as selection control signal. When the transfer data switching signal is at a logic level 0 (low level), the second selector 1103 selects and outputs the readout image data from the readout data register 1082.

Figure 12:
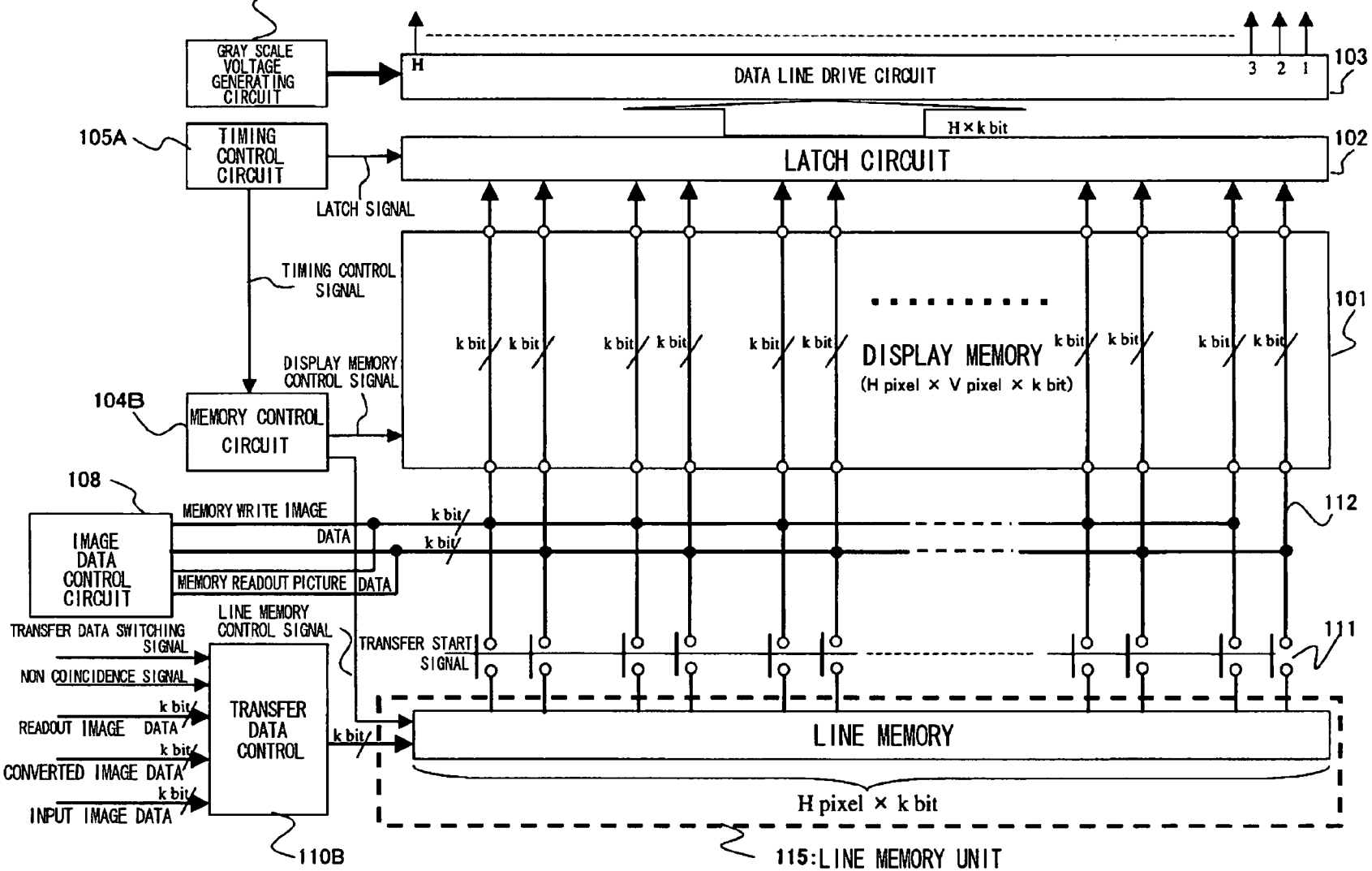
FIG. 12 is a diagram showing the configuration of a line memory in the third embodiment of the present invention.

FIG. 12 shows the configuration of the line memory and the near-by area of the third embodiment of the present invention. The k-bit image data, output from the transfer data control circuit 110B, is written in a relevant address of the line memory 115 for one line data. When one-line data has been written, the switches 111 are turned on by the activated transfer start signal from the memory control circuit 104 B, so that the one line image data from the line memory 115 are transferred on the interconnections 112 so as to be supplied to the input ends of the set of latch circuits 102 (H latch circuits). The timing control circuit 105A sends a common latch signal to the set of latch circuits 102 (H latch circuits). The data lines are driven by the set of data line drive circuits 103, at the grayscale voltage corresponding to the data signal. The lines of the selected gate lines are represented by the strobe signal STB.

Figure 13:
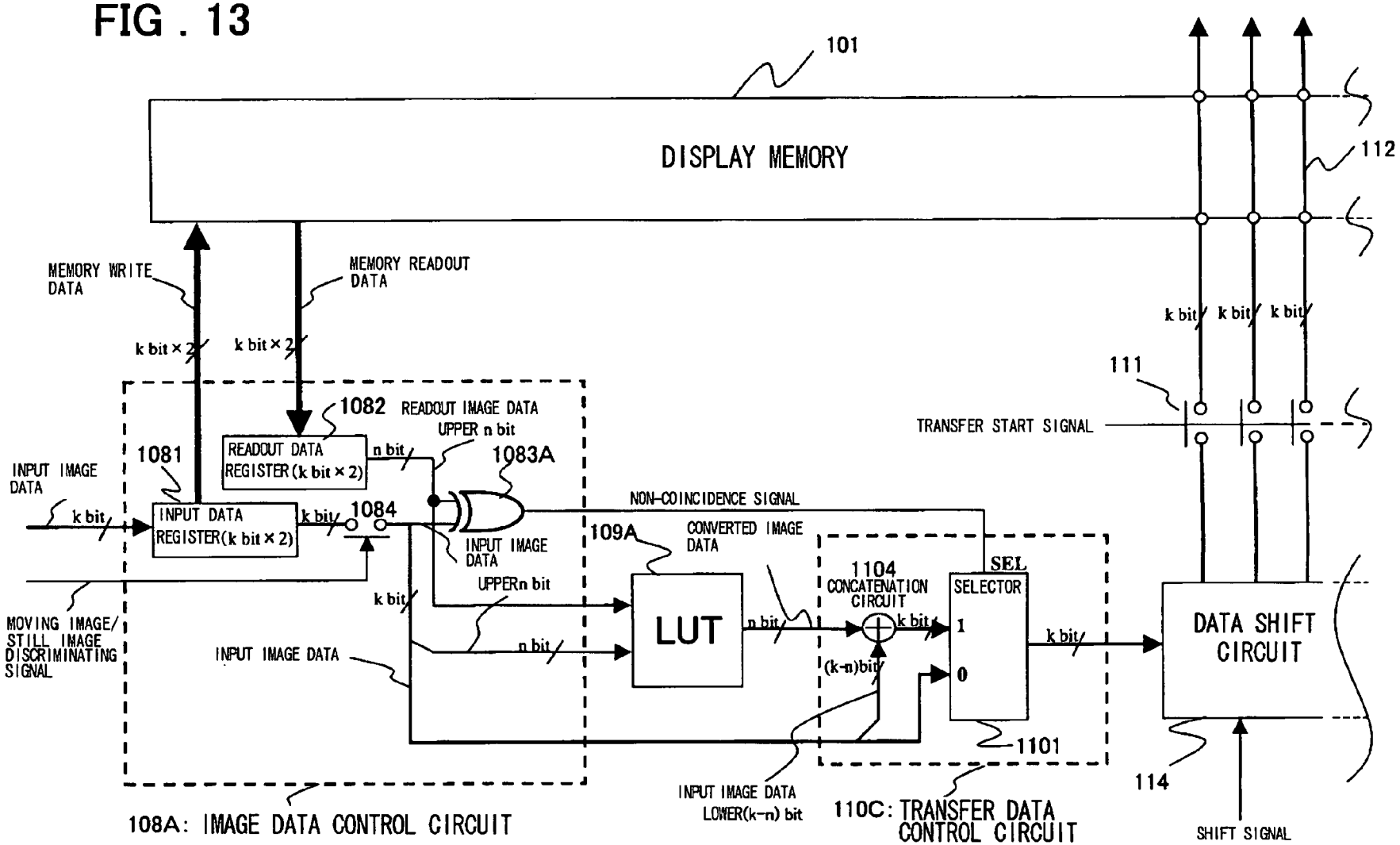
FIG. 13 is a diagram showing the circuit configuration in the vicinity of a LUT in a fourth embodiment of the present invention.

A fourth embodiment of the present invention will now be explained with reference to FIG. 13 showing the configuration thereof. In the present fourth embodiment, shown in FIG. 13, in detecting possible coincidence between the k bits of the readout image data and the k bits of the input image data, a non-coincidence detection circuit 1083A determines whether or not the upper n of the k bits coincide with each other.

A lookup table 109A receives upper n bits of the readout image data and upper n bits of the input image data and, based on these upper bits, outputs n-bit converted image data.

A concatenation circuit 1104 concatenates the n-bit converted image data, output from the lookup table 109A, and lower k-n bits of the input image data, to generate k-bit converted image data, which is supplied to the selector 1101.

When the non-coincidence signal from the non-coincidence detection circuit 1083A indicates non-coincidence and coincidence, the selector 1101 selectively outputs the converted image data from the concatenation circuit 1104 and the input image data, respectively.

In the present embodiment, the non-coincidence detection circuit 1083A detects the coincidence/non-coincidence of the n bits, while the lookup table 109A receives two pixel equivalent of the two sorts of the n bits to output an n-bit signal.

In the present embodiment, the possible presence of the over-drive is verified not by the entire bits of the image data but by changes in the upper bits. With the configuration of the present embodiment, the lookup table can be appreciably reduced in circuit size by reducing the number of the number of bits for comparison.

Figure 14:
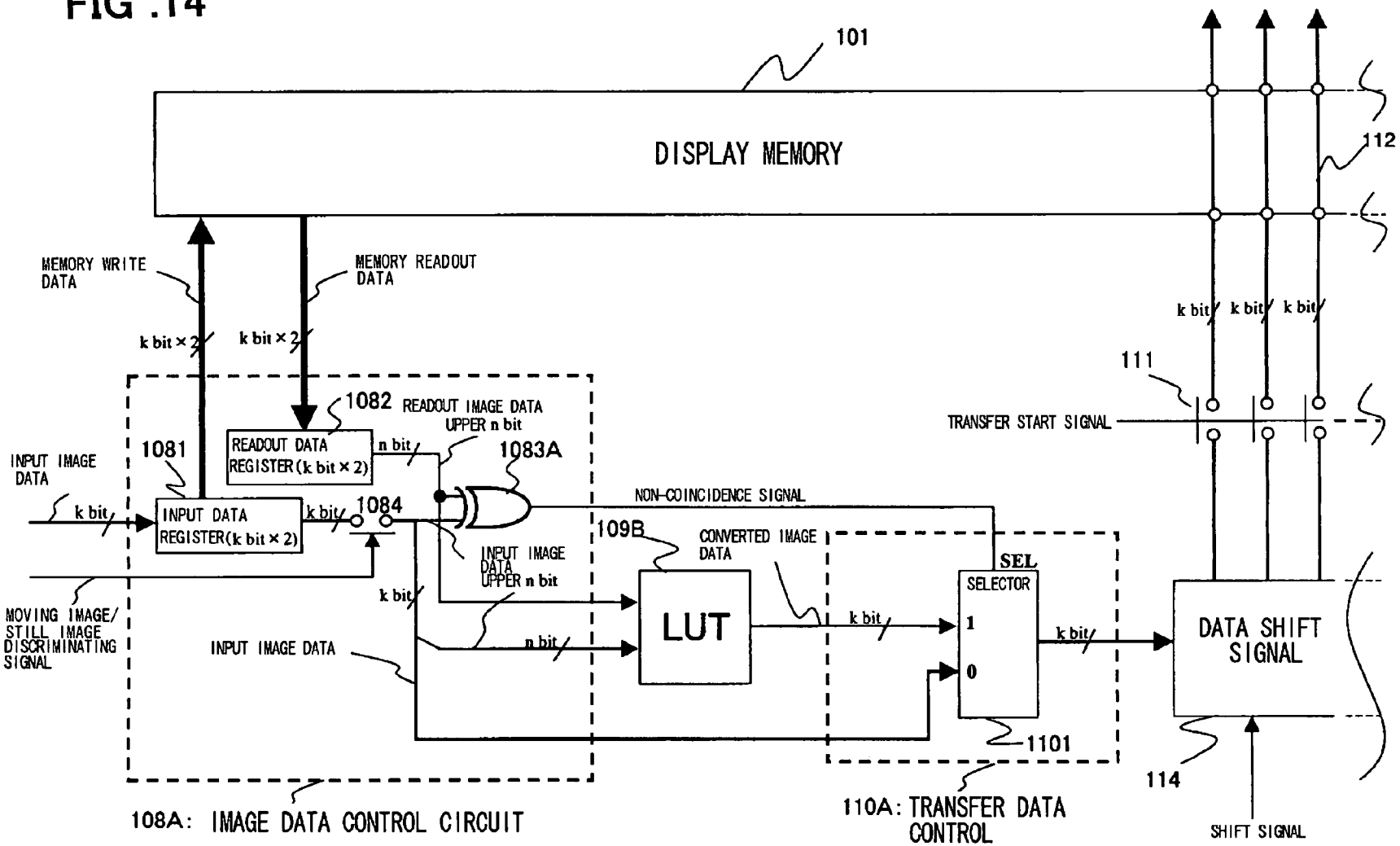
FIG. 14 is a diagram showing the circuit configuration in the vicinity of a LUT in a fifth embodiment of the present invention.

A fifth embodiment of the present invention will now be explained with reference to FIG. 14 showing the configuration thereof. In FIG. 14, the same parts or components as those shown in FIG. 13 are indicated by the same reference numerals. In the following, only the points of difference from the above-described fourth embodiment are explained. Referring to FIG. 14, a lookup table 109B may be supplied with upper n bits of the readout image data and upper n bits of the input image data to output k-bit converted image data, based on these upper n bits. In such case, the concatenation circuit 1104 is unnecessary.

In the above embodiments, the over-drive has been explained. The above configuration may be applied to e.g. gamma correction. The operation in this case is explained with reference to FIG. 1. A plural number of pixels are read out in parallel fashion from the display memory 101 and corrected for gamma by the lookup table 109. The image data are transferred to the set of latch circuits 102, as data transfer route for the display memory 101, to drive the data lines of the display unit 30 from the set of data line drive circuits 103 for display. The image data may be transferred to the set of latch circuits 102 as shown in the second and third embodiments instead of as shown in the first embodiment. The original image data are left in the display memory 101. Meanwhile, in the configuration shown in FIGS. 1, 5 and 9, the controller driver 10 may include the gate line drive circuit 31.

In each of the above-described embodiments, the image data control circuit 108 verifies, in the image data control circuit 108, whether or not the input image data is coincident with the image data one frame before, the non-coincidence signal, as the result of decision, to the transfer data control circuit 110, and selectively outputs one of the input image data and the converted image data from the lookup table 109, based on the non-coincidence signal, as shown for example in FIG. 1. As a modification, image data in case of coincidence between the input image data and the image data of the directly previous frame may be pre-set in the lookup table 109 to dispense with the non-coincidence detection circuit (1083 of FIG. 3) and the selector (1101 of FIG. 3). In this case, the converted image data (k bits), output from the lookup table 109, are sent to the transfer data register 1102, and transferred therefrom via switches 111 in the on-state to the interconnections (data buses) 112 to the set of latch circuits 102 (see FIG. 1). Moreover, in the configuration shown for example in FIG. 7, neither the non-coincidence detection circuit 1083 nor the selector 1101 is needed and the converted image data (k bits) output from the lookup table 109 are entered to the data shift circuit 114. On the other hand, in the configuration shown for example in FIG. 11, neither the non-coincidence detection circuit 1083 nor the selector 1101 is needed and the converted image data (k bits) output from the lookup table 109 are entered to the selector 1103. In addition, in the configuration shown for example in FIG. 13, neither the non-coincidence detection circuit 1083A nor the selector 1101 is needed and the converted image data (k bits) output from the lookup table 109 are entered via concatenation circuit 1104 to the data shift circuit 114. In similar manner, in the configuration shown for example in FIG. 14, neither the non-coincidence detection circuit 1083A nor the selector 1101 is needed and the converted image data (k bits) output from the lookup table 109B are entered to the data shift circuit 114.

Although the present invention has so far been explained with reference to the preferred embodiments thereof, the present invention is not limited to these embodiments, and may, of course, encompass a large variety of modifications and corrections that may occur to those skilled in the art within the scope of the invention as defined in the claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A controller driver comprising:

a display memory for storage of at least one frame of image data, and provided between an image rendering device and a display unit;

a memory control circuit for performing control for receiving input image data supplied from said image rendering device, reading out image data from an immediately preceding frame from said display memory and for writing said input image data as write image data in said display memory;

a converting circuit for outputting converted image data based on said input image data and said readout image data;

an image data control circuit for receiving a moving image/still image discriminating signal supplied from said image rendering device, said moving image/still image discriminating signal indicates that said input image data is of a moving or still image, and for receiving said input image data and said readout image data from the immediately preceding frame, read out from said display memory, to verify whether or not said input image data is coincident with said readout image data;

a transfer data control circuit for outputting said input image data or the converted image data if, based on the results of decision in said image data control circuit, said input image data and the converted image data are coincident or are not of equal value, respectively;

a plurality of latch circuits each for receiving the image data output from said transfer data control circuit either directly or via preset circuit when said moving image/still image discriminating signal indicates a moving image, or receiving the image data read out from said display memory when said moving image/still image discriminating signal indicates a still image, and latching the image data responsive to an input latch signal; and a plurality of data line drive circuits each for receiving image data output from said latch circuit for driving data lines of said display unit, respectively.

2. The controller driver as claimed in claim 1, further comprising:

a shift circuit for generating and supplying latch signal for each of a plurality of said latch circuits;

wherein one of said converted image data and the input image data, output from said transfer data control circuit over data transfer lines is latched by those of said plural latch circuits associated with said image data.

3. The controller driver as claimed in claim 1, further comprising:

a data shift circuit for receiving and sequentially shifting one of said converted image data and the input image data output from said transfer data control circuit to store one line equivalent of pixels of image data;

wherein input ends of said plural latch circuits and output ends of said data shift circuit are connected via switches and data transfer lines, when said switches are on, to latch the one line equivalent of image data output in a parallel fashion from said data shift circuit responsive to a common latch signal to said plural latch circuits.

4. The controller driver as claimed in claim 1, further comprising:

a line memory for storing one of said converted image data and the input image data output from said transfer data control circuit in relevant addresses for storing one line equivalent of pixel data;

wherein the input ends of said plural latch circuits and output ends of said line memory are connected via switches and data transfer lines, when said switches are one, to latch one line equivalent of the image data output in a parallel fashion from said line memory responsive to a common latch signal to said plural latch circuits.

5. The controller driver as claimed in claim 2, wherein a data bus for the display memory for transferring image data from said display memory to said latch circuits is used as said data transfer lines for transmitting one of said converted image data and the input image data.

6. The controller driver as claimed in claim 5, wherein said memory control circuit performs switching control at a preset timing, excluding the time for readout and writing for said display memory, for using said data bus for the display memory for transferring image data from said display memory to said plural latch circuits as said data transfer lines for transmitting one of said converted image data and the input image data.

7. The controller driver as claimed in claim 2, wherein when said moving image/still image discriminating signal indicates a still image, said switches are turned off to stop said converting circuit, said input image data are written as write data in said display memory, said plural latch circuits, receiving one line of image data output from said display memory, are responsive to the latch signal to latch the image data to send the data to said plural data line drive circuits; and wherein when said moving image/still image discriminating signal indicates a moving image, said switches are turned on to operate said converting circuit, said image data control circuit verifies whether or not said input image data and readout image data from the immediately preceding frame are of equal value, converted image data or input image data output from said transfer data control circuit are supplied via said switches in the on-state to inputs of relevant latch circuits, and outputs of said latch circuits are supplied to said data line drive circuits.

8. The controller driver as claimed in claim 3, wherein when said moving image/still image discriminating signal indicates a still image, said switches are turned off to stop said converting circuit, said input image data are written as write data in said display memory, said plural latch circuits, receiving one line of image data output from said display memory, are responsive to the common latch signal to latch the image data to send the data to said plural data line drive circuits; and wherein when said moving image/still image discriminating signal indicates a moving image, said switches are turned on to operate said converting circuit, said image data control circuit verifies whether or not said input image data and readout image data from the immediately preceding frame are of equal value, converted image data or input image data output from said transfer data control circuit are supplied via said switches in the on-state to inputs of relevant latch circuits, and outputs of said latch circuits are supplied to said data line drive circuits.

9. The controller driver as claimed in claim 2, wherein said image data control circuit comprises:

an input data register for storing at least one of said input image data supplied from said image rendering device and for supplying said data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit determining whether or not said input image data and readout image data from the immediately preceding frame are of equal value and outputting a signal indicating the result of decision;

said converting circuit receiving said input image data output from an output end of said control switch and readout image data from the immediately preceding frame from said readout data register;

a selector receiving said converted image data output from said converting circuit and said input image data from the output end of said control switch, said selector selecting and outputting said converted image data and said input image data when said decision result signal indicates non-coincidence and coincidence, respectively; and a transfer data register receiving an output of said selector to output and hold image data to be transferred to said latch circuit.

10. The controller driver as claimed in claim 3, wherein said image data control circuit includes an input data register for storing at least one of said input image data supplied from said image rendering device and for supplying said data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit determining whether or not said input image data and readout image data from the immediately preceding frame are of equal value and outputting a signal indicating the result of decision;

said converting circuit receiving said input image data output from an output end of said control switch and readout image data from the immediately preceding frame from said readout data register; and a selector receiving said converted image data output from said converting circuit and said input image data from the output end of said control switch, said selector selecting and outputting said converted image data and said input image data when said decision result signal indicates non-coincidence and coincidence, respectively;

an output of said selector being supplied to said data shift circuit.

11. The controller driver as claimed in claim 4, wherein said image data control circuit includes an input data register for storing at least one of said input image data supplied from said image rendering device and for supplying said data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit determining whether or not said input image data and readout image data from the immediately preceding frame are of equal value and outputting a signal indicating the result of decision;

said converting circuit receiving said input image data output from an output end of said control switch and readout image data from the immediately preceding frame from said readout data register;

a first selector receiving said converted image data output from said converting circuit and said input image data from the output end of said control switch, said selector selecting and outputting said converted image data and said input image data when said decision result signal indicates non-coincidence and coincidence, respectively; and a second selector receiving an output of said first selector and readout image data from said readout data register, said second selector selecting and outputting, by address data transferred along with said input image data from said image rendering device, an output of said first selector or readout image data from said readout data register, when a transfer data switching signal generated by said memory control circuit is in an activated state or in a non-activated state, respectively;

an output of said second selector being supplied to said data shift circuit.

12. The controller driver as claimed in claim 2, wherein said image data control circuit comprises:

an input data register for storing at least one input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving upper n bits of the input image data output from an output end of said control switch and upper n bits of readout image data from said readout data register to output upper n bits of associated converted image data;

said transfer data control circuit including a concatenating circuit for concatenating upper n bits of said converted image data output from said converting circuit and lower (k-n) bits of said input image data to generate converted image data of k bits; and a selector receiving image data output from said concatenating circuit and said input image data output from said control switch, said selector selecting and outputting converted image data output from said concatenating circuit and said input image data when said decision result signal indicates non coincidence and coincidence, respectively.

13. The controller driver as claimed in claim 2, wherein said image data control circuit comprises:

an input data register for storing at least one input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image;

a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving said n bits of the input image data output from an output end of said control switch and upper n bits of readout image data from said readout data register to output said converted image data of k bits; and a selector receiving said converted image data and said input image data output from said control switch, said selector selecting and outputting said converted image data and said input image data when said decision result signal indicates non-coincidence and coincidence, respectively.

14. The controller driver as claimed in claim 2, wherein the controller driver comprises:

a timing control circuit;

said shift circuit including a shift register made up by cascaded flip-flops receiving a latch signal for moving images, output from said timing control circuit at a first stage thereof to sequentially transfer said latch signal for moving images, based on a shift signal entered from said timing control circuit; and a plurality of logic gates receiving outputs of respective stages of said flip-flops and a latch signal for a still image from said timing control circuit, said logic gates sending out outputs of said flip-flops and said latch signal for the still image when said latch signal for said still image indicates an inactivated state and an activated state, respectively;

a latch signal being supplied from outputs of said plural logic gates to said latch circuits.

15. The controller driver as claimed in claim 2, wherein a plurality of write image data are transferred in terms of a plural number of pixels as a unit to said display memory at a frequency divided from a clock frequency of a transfer in terms of a pixel as a unit; and wherein in case of moving images, readout of plural pixels of image data and writing of plural pixels of image data occur alternately with a time shift relative to each other, such that, in said display memory, write image data of a pixel in said display memory are written in the same address as that of readout image data of a pixel from the immediately preceding frame of the write image data of the first stated pixel.

16. The controller driver as claimed in claim 2, wherein said converting circuit outputs image data for over-drive driving as said converted image data.

17. A semiconductor device having the controller driver as claimed in claim 2 on a semiconductor substrate.

18. A display device comprising said controller device and said display unit as claimed in claim 2.

19. The controller driver as claimed in claim 4, wherein when said moving image/still image discriminating signal indicates a still image, said switches are turned off to stop said converting circuit, said input image data are written as write data in said display memory, said plural latch circuits, receiving one line of image data output from said display memory, are responsive to the common latch signal to latch the image data to send the data to said plural data line drive circuits; and wherein when said moving image/still image discriminating signal indicates a moving image, said switches are turned on to operate said converting circuit, said image data control circuit verifies whether or not said input image data and readout image data from the immediately preceding frame are of equal value, converted image data or input image data output from said transfer data control circuit are supplied via said switches in the on-state to inputs of relevant latch circuits, and outputs of said latch circuits are supplied to said data line drive circuits.

20. The controller driver as claimed in claim 3, wherein a data bus for the display memory for transferring image data from said display memory to said latch circuits is used as said data transfer lines for transmitting one of said converted image data and the input image data.

21. The controller driver as claimed in claim 4, wherein a data bus for the display memory for transferring image data from said display memory to said latch circuits is used as said data transfer lines for transmitting one of said converted image data and the input image data.

22. The controller driver as claimed in claim 3, wherein said image data control circuit comprises:

an input data register for storing at least one input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving upper n bits of the input image data output from an output end of said control switch and upper n bits of readout image data from said readout data register to output upper n bits of associated converted image data;

said transfer data control circuit including a concatenating circuit for concatenating upper n bits of said converted image data output from said converting circuit and lower (k-n) bits of said input image data to generate converted image data of k bits; and a selector receiving image data output from said concatenating circuit and said input image data output from said control switch, said selector selecting and outputting converted image data output from said concatenating circuit and said input image data when said decision result signal indicates non-coincidence and coincidence, respectively.

23. The controller driver as claimed in claim 4, wherein said image data control circuit comprises:

an input data register for storing at least one input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image; and a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving upper n bits of the input image data output from an output end of said control switch and upper n bits of readout image data from said readout data register to output upper n bits of associated converted image data;

said transfer data control circuit including a concatenating circuit for concatenating upper n bits of said converted image data output from said converting circuit and lower (k-n) bits of said input image data to generate converted image data of k bits; and a selector receiving image data output from said concatenating circuit and said input image data output from said control switch, said selector selecting and outputting converted image data output from said concatenating circuit and said input image data when said decision result signal indicates non-coincidence and coincidence, respectively.

24. The controller driver as claimed in claim 3, wherein said image data control circuit comprises:

an input data register for storing at least one of said input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image;

a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving said n bits of the input image data output from an output end of said control switch and upper n bits of readout image data from said readout data register to output said converted image data of k bits; and a selector receiving said converted image data and said input image data output from said control switch, said selector selecting and outputting said converted image data and said input image data when said decision result signal indicates non-coincidence and coincidence, respectively.

25. The controller driver as claimed in claim 4, wherein said image data control circuit comprises:

an input data register for storing at least one of said input image data supplied from said image rendering device and for supplying the stored data as write image data to said display memory;

a readout data register for storing at least one readout image data read out from said display memory;

a control switch having an input end connected to an output of said input data register, said control switch being set to an on-state in case the moving image/still image discriminating signal supplied from said image rendering device indicates a moving image;

a decision circuit having an input end connected to an output end of said control switch and having the other input end connected to said readout data register, said decision circuit verifying whether or not upper n bits of the input image data (k bits), n being a preset positive integer smaller than k, are coincident with upper n bits of the readout image data, and outputting a decision result signal;

said converting circuit receiving said n bits of the input image data output from an output end of said control switch and upper n bits of readout image data from said readout data register to output said converted image data of k bits; and a selector receiving said converted image data and said input image data output from said control switch, said selector selecting and outputting said converted image data and said input image data when said decision result signal indicates non-coincidence and coincidence, respectively.

* * * * *

UNITED STATES PATENT AND TRADEMARK OFFICE

CERTIFICATE OF CORRECTION

PATENT NO. : 7,586,485 B2
APPLICATION NO. : 11/129470
DATED : September 8, 2009
INVENTOR(S) : Teshirogi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1150 days.

Signed and Sealed this

Fourteenth Day of September, 2010

David J. Kappos

David J. Kappos
*Director of the United States Patent and Trademark Office*